US007719530B2

(12) United States Patent
Ono

(10) Patent No.: US 7,719,530 B2
(45) Date of Patent: May 18, 2010

(54) IMAGE DISPLAY CONTROL APPARATUS AND IMAGE DISPLAY CONTROL METHOD

(75) Inventor: Yoshihiro Ono, Tokyo (JP)

(73) Assignee: Sony Corporation (JP)

( * ) Notice: Subject to any disclaimer, the term of this patent is extended or adjusted under 35 U.S.C. 154(b) by 1001 days.

(21) Appl. No.: 10/855,221

(22) Filed: May 27, 2004

(65) Prior Publication Data

US 2004/0252135 A1 Dec. 16, 2004

(30) Foreign Application Priority Data

Jun. 13, 2003 (JP) ..... P2003-169220
Mar. 23, 2004 (JP) ..... P2004-084508

(51) Int. Cl.
*G09G 5/00* (2006.01)

(52) U.S. Cl. ..... 345/214; 345/204; 345/60; 715/867

(58) Field of Classification Search ..... 345/204, 345/618–619, 690, 694, 698–699, 41–42, 345/55–56; 348/173; 715/867
See application file for complete search history.

(56) References Cited

U.S. PATENT DOCUMENTS

| | | | | |
|---|---|---|---|---|
| 5,805,172 | A * | 9/1998 | Brown | 345/442 |
| 6,072,446 | A * | 6/2000 | Tokimoto | 345/56 |
| 6,377,275 | B1 * | 4/2002 | Kim | 345/618 |
| 6,628,247 | B2 * | 9/2003 | Toffolo et al. | 345/31 |
| 2001/0035874 | A1 * | 11/2001 | Hamilton et al. | 345/682 |
| 2002/0044143 | A1 | 4/2002 | Kota et al. | |
| 2004/0125097 | A1 * | 7/2004 | McKay | 345/204 |
| 2007/0236410 | A1 * | 10/2007 | Shimizu | 345/20 |

FOREIGN PATENT DOCUMENTS

| | | |
|---|---|---|
| JP | 4022989 | 1/1992 |
| JP | 5134618 | 5/1993 |
| JP | 8248934 | 9/1996 |
| JP | 9050258 | 2/1997 |
| JP | 9319322 | 12/1997 |
| JP | 10011028 | 1/1998 |
| JP | 10020838 | 1/1998 |
| JP | 10-071242 | 3/1998 |
| JP | 11086388 | 3/1999 |
| JP | 11313229 | 11/1999 |
| JP | 2000227775 | 8/2000 |
| WO | WO 0068888 A1 * | 11/2000 |

OTHER PUBLICATIONS

European Search Report, EP 04253338, dated Apr. 15, 2009.

* cited by examiner

*Primary Examiner*—Alexander Eisen
*Assistant Examiner*—Jason M Mandeville
(74) *Attorney, Agent, or Firm*—Lerner, David, Littenberg, Krumholz & Mentlik, LLP

(57) ABSTRACT

An image is moved and displayed through an image movement orbit composed of one or more annular orbits. The annular orbit is set such that a central point of the image to be displayed on a display screen is defined as a reference position, and the reference position is used as a start point, and this reference position is returned to when a movement corresponding to one round is completed. Thus, the image movement orbit is established so as to always pass through a reference point, for each cycle of an annular orbit. As a result of such image movement, the image movement as a pixel shift is unrecognizable so as to reduce ghost effects.

6 Claims, 16 Drawing Sheets

| | | | | | | | | | | | | | | | | | | | | | | |
|---|---|---|---|---|---|---|---|---|---|---|---|---|---|---|---|---|---|---|---|---|---|---|
| (1) | 3 | 5 | 7 | 9 | 11 | 13 | 13 | 13 | 11 | 9 | 7 | 5 | 3 | | | | | | | | | |
| (2) | 3 | 5 | 7 | 9 | 11 | 13 | 13 | 13 | 11 | 9 | 7 | 5 | 3 | | | | | | | | | |
| (3) | 3 | 5 | 7 | 9 | 11 | 13 | 13 | 13 | 11 | 9 | 7 | 5 | 3 | | | | | | | | | |
| (4) | 3 | 5 | 7 | 9 | 11 | 13 | 13 | 13 | 11 | 9 | 7 | 5 | 3 | | | | | | | | | |
| TOTAL NUMBER OF OCCURRENCES | 0 | 6 | 10 | 14 | 18 | 22 | 26 | 32 | 36 | 36 | 36 | 36 | 36 | 32 | 26 | 22 | 18 | 14 | 10 | 6 | 0 | 0 |

FIG. 6

ANNULAR ORBIT (1)

| | V | H |
|---|---|---|
| 0 | 0 | 0 |
| 1 | 0 | -1 |
| 2 | 1 | -1 |
| 3 | 1 | -2 |
| 4 | 2 | -2 |
| 5 | 2 | -3 |
| 6 | 3 | -3 |
| 7 | 4 | -3 |
| 8 | 4 | -2 |
| 9 | 5 | -2 |
| 10 | 5 | -1 |
| 11 | 6 | -1 |
| 12 | 6 | 0 |
| 13 | 7 | 0 |
| 14 | 7 | 1 |
| 15 | 8 | 1 |
| 16 | 8 | 2 |
| 17 | 9 | 2 |
| 18 | 9 | 3 |
| 19 | 9 | 4 |
| 20 | 8 | 4 |
| 21 | 8 | 5 |
| 22 | 7 | 5 |
| 23 | 7 | 6 |
| 24 | 6 | 6 |
| 25 | 6 | 7 |
| 26 | 5 | 7 |
| 27 | 5 | 8 |
| 28 | 4 | 8 |
| 29 | 4 | 9 |
| 30 | 3 | 9 |
| 31 | 2 | 9 |
| 32 | 2 | 8 |
| 33 | 1 | 8 |
| 34 | 1 | 7 |
| 35 | 0 | 7 |
| 36 | 0 | 6 |
| 37 | -1 | 6 |
| 38 | -1 | 5 |
| 39 | -2 | 5 |
| 40 | -2 | 4 |
| 41 | -3 | 4 |
| 42 | -3 | 3 |
| 43 | -3 | 2 |
| 44 | -2 | 2 |
| 45 | -2 | 1 |
| 46 | -1 | 1 |
| 47 | -1 | 0 |

ANNULAR ORBIT (2)

| | V | H |
|---|---|---|
| 48 | 0 | 0 |
| 49 | 1 | 0 |
| 50 | 1 | -1 |
| 51 | 2 | -1 |
| 52 | 2 | -2 |
| 53 | 3 | -2 |
| 54 | 3 | -3 |
| 55 | 3 | -4 |
| 56 | 2 | -4 |
| 57 | 2 | -5 |
| 58 | 1 | -5 |
| 59 | 1 | -6 |
| 60 | 0 | -6 |
| 61 | 0 | -7 |
| 62 | -1 | -7 |
| 63 | -1 | -8 |
| 64 | -2 | -8 |
| 65 | -2 | -9 |
| 66 | -3 | -9 |
| 67 | -4 | -9 |
| 68 | -4 | -8 |
| 69 | -5 | -8 |
| 70 | -5 | -7 |
| 71 | -6 | -7 |
| 72 | -6 | -6 |
| 73 | -7 | -6 |
| 74 | -7 | -5 |
| 75 | -8 | -5 |
| 76 | -8 | -4 |
| 77 | -9 | -4 |
| 78 | -9 | -3 |
| 79 | -9 | -2 |
| 80 | -8 | -2 |
| 81 | -8 | -1 |
| 82 | -7 | -1 |
| 83 | -7 | 0 |
| 84 | -6 | 0 |
| 85 | -6 | 1 |
| 86 | -5 | 1 |
| 87 | -5 | 2 |
| 88 | -4 | 2 |
| 89 | -4 | 3 |
| 90 | -3 | 3 |
| 91 | -2 | 3 |
| 92 | -2 | 2 |
| 93 | -1 | 2 |
| 94 | -1 | 1 |
| 95 | 0 | 1 |

ANNULAR ORBIT (3)

| | V | H |
|---|---|---|
| 96 | 0 | 0 |
| 97 | 0 | -1 |
| 98 | -1 | -1 |
| 99 | -1 | -2 |
| 100 | -2 | -2 |
| 101 | -2 | -3 |
| 102 | -3 | -3 |
| 103 | -4 | -3 |
| 104 | -4 | -2 |
| 105 | -5 | -2 |
| 106 | -5 | -1 |
| 107 | -6 | -1 |
| 108 | -6 | 0 |
| 109 | -7 | 0 |
| 110 | -7 | 1 |
| 111 | -8 | 1 |
| 112 | -8 | 2 |
| 113 | -9 | 2 |
| 114 | -9 | 3 |
| 115 | -9 | 4 |
| 116 | -8 | 4 |
| 117 | -8 | 5 |
| 118 | -7 | 5 |
| 119 | -7 | 6 |
| 120 | -6 | 6 |
| 121 | -6 | 7 |
| 122 | -5 | 7 |
| 123 | -5 | 8 |
| 124 | -4 | 8 |
| 125 | -4 | 9 |
| 126 | -3 | 9 |
| 127 | -2 | 9 |
| 128 | -2 | 8 |
| 129 | -1 | 8 |
| 130 | -1 | 7 |
| 131 | 0 | 7 |
| 132 | 0 | 6 |
| 133 | 1 | 6 |
| 134 | 1 | 5 |
| 135 | 2 | 5 |
| 136 | 2 | 4 |
| 137 | 3 | 4 |
| 138 | 3 | 3 |
| 139 | 3 | 2 |
| 140 | 2 | 2 |
| 141 | 2 | 1 |
| 142 | 1 | 1 |
| 143 | 1 | 0 |

ANNULAR ORBIT (4)

| | V | H |
|---|---|---|
| 144 | 0 | 0 |
| 145 | -1 | 0 |
| 146 | -1 | -1 |
| 147 | -2 | -1 |
| 148 | -2 | -2 |
| 149 | -3 | -2 |
| 150 | -3 | -3 |
| 151 | -3 | -4 |
| 152 | -2 | -4 |
| 153 | -2 | -5 |
| 154 | -1 | -5 |
| 155 | -1 | -6 |
| 156 | 0 | -6 |
| 157 | 0 | -7 |
| 158 | 1 | -7 |
| 159 | 1 | -8 |
| 160 | 2 | -8 |
| 161 | 2 | -9 |
| 162 | 3 | -9 |
| 163 | 4 | -9 |
| 164 | 4 | -8 |
| 165 | 5 | -8 |
| 166 | 5 | -7 |
| 167 | 6 | -7 |
| 168 | 6 | -6 |
| 169 | 7 | -6 |
| 170 | 7 | -5 |
| 171 | 8 | -5 |
| 172 | 8 | -4 |
| 173 | 9 | -4 |
| 174 | 9 | -3 |
| 175 | 9 | -2 |
| 176 | 8 | -2 |
| 177 | 8 | -1 |
| 178 | 7 | -1 |
| 179 | 7 | 0 |
| 180 | 6 | 0 |
| 181 | 6 | 1 |
| 182 | 5 | 1 |
| 183 | 5 | 2 |
| 184 | 4 | 2 |
| 185 | 4 | 3 |
| 186 | 3 | 3 |
| 187 | 2 | 3 |
| 188 | 2 | 2 |
| 189 | 1 | 2 |
| 190 | 1 | 1 |
| 191 | 0 | 1 |

| | | | | | | | | | | | | | | | | | | | | | | |
|---|---|---|---|---|---|---|---|---|---|---|---|---|---|---|---|---|---|---|---|---|---|---|
| (1) | | | | | | | | | | | 3 | 4 | 4 | 4 | 2 | 4 | 4 | 4 | 3 | | | |
| (2) | | | | | | | | | | | 3 | 4 | 4 | 4 | 2 | 4 | 4 | 4 | 3 | | | |
| (3) | | | 3 | 4 | 4 | 4 | 2 | 4 | 4 | 4 | 3 | | | | | | | | | | | |
| (4) | | | | | | | | | | | 3 | 4 | 4 | 4 | 2 | 4 | 4 | 4 | 3 | | | |
| TOTAL NUMBER OF OCCURRENCES | 0 | 0 | 3 | 4 | 4 | 4 | 8 | 12 | 12 | 12 | 10 | 12 | 12 | 12 | 8 | 4 | 4 | 4 | 3 | 0 | 0 | 0 |

IMAGE DISPLAY CONTROL APPARATUS AND IMAGE DISPLAY CONTROL METHOD

CROSS REFERENCE TO RELATED APPLICATIONS

The present document is based on Japanese Priority Application JP2003-169220 filed in the Japanese Patent Office on Jun. 13, 2003, the contents in which being incorporated herein by reference to the extent permitted by law.

BACKGROUND OF THE INVENTION

1. Field of the Invention

The present invention relates to an image display control apparatus for executing a control to display images by image signal input and a method thereof.

2. Description of Related Art

Plasma display apparatuses have become popular as displaying apparatuses for image display, As an example of displaying principle for plasma displays, gas is for example sealed into a space formed by making two sheets of glass substrate opposite to each other and surrounding with a barrier rib. Then, by applying a voltage to the gas, vacuum discharge is induced. Consequently, within the space of the glass substrate, the gas is ionized and becomes at plasma state, thereby radiating ultraviolet radiation. Here, if a fluorescent substance layer is preliminarily formed within the space between the glass substrates, in this fluorescent substance layer, the ultraviolet radiation is irradiated, thereby radiating the visible light of a predetermined color. As such a fluorescent substance, by forming the substance corresponding to the three colors of R, G and B and then obtaining the above-mentioned discharge light emission phenomenon for each formed display cell having, for example, the shape of a matrix, the plasma display apparatus is configured which enables the color image to be displayed.

Also, a sub-field method is known as a method of display driving for the above-mentioned plasma display apparatus.

The sub-field method is the driving method of dividing one field into a plurality of sub-fields, and controlling the light emission period of a display cell for each sub-field, and then representing the gradation (brightness) of each display cell. At this time, the gradation of each display cell of R, G and B constituting one pixel is controlled, thereby carrying out not only the gradation balance on the entire screen but also the color reproduction for each pixel. In other words, the color image can be represented.

SUMMARY OF THE INVENTION

As mentioned above, the image light displayed on the plasma display apparatus is obtained from the visible light radiated from the fluorescent substance layer. However, it is known that this fluorescent substance layer is deteriorated corresponding to usage time lapse. Such deterioration in the fluorescent substance is caused by the ultraviolet light (ultraviolet rays) irradiated by the vacuum discharge, the shock of the ions generated within the vacuum space, and the like.

Thus, the deterioration in the fluorescent substance progresses as the accumulated time of the light emission becomes longer. Then, in the actual displaying, the accumulated time of light emissions of the fluorescent substances corresponding to the respective display cells are not uniform, which brings about the variation on the basis of the images displayed until this time. In other words, the variation is induced in the degrees of the deteriorations in the fluorescent substances between the display cells.

The deterioration in the fluorescent substance appears as a drop in brightness of light emission. As mentioned above, the fact that variation is induced in the deterioration in the fluorescent substance corresponding to each display cell results in the variation in the brightness of light emission of the fluorescent substance. For example, if the variation in the brightness of light emission is induced between the fluorescent substances. Also, for example, if the variation in the brightness of light emission is induced between the fluorescent substances of R, G and B constituting one pixel, white balance is also disturbed.

Consequently, even if considered as the entire display screen, there may be a case that the portion, which is the region to be originally displayed in the same brightness and coloration and in which the deterioration is in advanced stage, appears to be displayed in the brightness and coloration which are different from the surroundings. This is referred to as a so-called ghost effect. If the ghost is generated, for example, the region in which the fluorescent substance is deteriorated is displayed as a fixed pattern so as to overlap with an image is supposed to be displayed. Thus, this constitutes a traditional problem taken as a factor by which the displayed image quality is deteriorated.

As an example of ghost effect, there is for example a case in which because of the relation of an aspect ratio of a screen size to a display image, black portions are frequently displayed on the upper and lower or right and left portions of an image portion. As compared with the fluorescent substance of the image portion displayed as the black portion, the fluorescent substance of the image portion has a relatively long accumulated time of light emission. As a result, between a display region as the image portion and a display region as the black portion, the degree of the deterioration of the fluorescent substance greatly differs, which induces the ghost in which the boundaries between the image portion and the black portion is shown to be clear.

Also, for example, in a case that an image source such as a movie and the like is desired to be well displayed, the portion on which white subtitles are displayed has an accumulated time of light emission of the fluorescent substance that is longer than those of the other display regions. Thus, the ghost appears as a fixed pattern.

So, as the solution to the above-mentioned ghost, a method so-called pixel shift is known, in which the display positions of the image are shifted, little by little, when the image is displayed. If the image display is carried out by using such pixel shift, for example, the positions of the display cells constituting the image portion to be reproduced at a high brightness can be shifted, thereby suppressing the progress of the deterioration in only the fluorescent substance corresponding to the particular display cell. In other words, the image display is carried out so as to reduce the ghost effect.

As such method of pixel shift, conventionally, the display position of the image has been shifted, for example, as shown in FIGS. 14A, 14B.

In other words, as conceptually shown in FIG. 14A, a circular orbit of a constant diameter size is assumed to be an annular orbit. Then, the entire image to be displayed on a display screen 200 is moved in accordance with this circular orbit.

When such an image movement is viewed as the motion of one pixel in the entire image displayed on a plasma display apparatus, for example, it can be shown in FIG. 14B.

By the way, in the explanation from this point, the image portion at the particular position corresponding to a pixel unit serving as an element constituting an image is referred to as a pixel correspondence image portion. Also, as an example of a structure for the plasma display apparatus, one pixel constituted by a set of display cells of R, G and B is referred to as a display pixel. In other words, when the pixel shift is carried out, the plasma display apparatus is designed such that the pixel correspondence image portion is moved with respect to the display pixel formed in the shape of a matrix.

This pixel correspondence image portion is fixedly displayed at a position of a display pixel Pcnt, if the pixel shift is not done. On the contrary, if the pixel shift is done, for example, the pixel correspondence image portion is firstly moved to a position of a display pixel P1. The display pixel P1 is located at the position that is indicated as 250 of FIG. 14A and corresponds to the top on the circular orbit, on the display screen, after the display pixel Pcnt is set at the center of the circular orbit.

Then, the movement between the display pixels is started from this display pixel P1 along the traveling direction of the circular orbit indicated by the arrow in FIG. 14A. Consequently, this pixel correspondence image portion sequentially travels and moves from the display pixel P1 and arrives at a display pixel P2, which is located at the leftmost side on the circular orbit, namely, indicated by 260 of FIG. 14A. Since further moving, it sequentially passes through a display pixel P3 located at the lowermost side on the circular orbit and a display pixel P4 located at the rightmost side. Finally, the fact that it arrives at a display pixel P5 right adjacent to the display pixel P1 implies that it makes a round of this circular orbit. Hereafter, the movement of the pixel correspondence image portion through the similar circular orbit is repeated with the display pixel P1 as the start point, as mentioned above.

By the way, the display pixels on the display screen of the plasma display apparatus are formed in the shape of the matrix, along vertical/horizontal directions. Thus, as can be understood from FIG. 14B, the movement pattern of the pixel correspondence image portion is not exactly circular in shape. However, here, the circular shape is assumed, and the annular orbit obtained when the movement between the display pixels is carried out in the locus shape as close as possible to this circular shape is referred to as a circular orbit.

However, in the above-mentioned conventional pixel shift shown in FIG. 14A, the movement pattern of the image is defined as a single annular orbit (the circular orbit). Also, as explained in FIG. 14B, the image is moved in accordance with the circular orbit with the original display position on the display screen as the center. In other words, as the display image, the movement is always started from the position displaced from the original display position. For this reason, the fact that the image is moved by the pixel shift is liable to be visually recognized, which correspondingly leads to a poor image quality.

From the viewpoint of the reduction of the ghost effect, the image movement as the pixel shift at the time of the image display is desired to be steadily executed. However, actually, the fact that the image is moved as mentioned above is liable to be visually recognized. Thus, the pixel shift is typically executed at a certain interval in accordance with a predetermined condition and rule without being steadily executed. For example, the pixel shift is executed for each constant interval. Also, when the display image is static, the ghost is easily induced. Hence, a method is also proposed for starting the pixel shift when the display image is judged to be static for a certain time or longer.

However, in order to execute the pixel shift at the interval as mentioned above, it is necessary to add the configuration that can execute the control to do so. For example, in the former case, it is necessary to add a timer for starting. Also, in the latter case, it is necessary to add the circuit section and program to attain: an average brightness detecting function of detecting the static state of the image; a memory function of storing the detected result by this average brightness detecting function; and a judging function of judging whether or not the image is at the static state in accordance with the detection information stored by this memory function. That is, the circuit configuration or the program configuration becomes complex, which results in a problem that the efficient design of the apparatus is disturbed and the cost is increased.

The present invention has been considered in view of the above-mentioned subjects and there is proposed an image display control apparatus for executing a display control to display an image based on an input image signal on a displaying apparatus having a display screen, the image display control apparatus including: display controller configured to move and display the image through an image movement orbit including at least an annular orbit having a central point of the image as a reference position which is used as a starting and returning point, and to repeatedly execute the image movement.

In addition, the display controller may include a plurality of annular orbits sharing the reference position; in which the plurality of annular orbits are sequentially selected, and the display control is executed so that the image is moved and displayed through the selected annular orbit.

Also, the image display control apparatus according to the preferred embodiment of the invention may further include a random number generator, wherein the display controller selects from the annular orbits an annular orbit from which image movement begins, based on the random number generated by the random number generator.

Furthermore, the image display control apparatus according to the preferred embodiment of the invention may include a holding device configured to measure and hold an accumulated energized time of the image display control apparatus; wherein the display controller selects from the plurality of annular orbits constituting the image movement orbit an annular orbit from which image movement begins, based on a value of the accumulated energized time.

In addition, the display controller may have two pairs of annular orbits having the reference position as their contact position over a tangential line; wherein and a positional relation between the two pair of annular orbits is set such that the tangential line of one pair of annular orbits and the tangential line of the other pair of annular orbits are orthogonal to each other.

Also, the display screen may be formed in a shape of matrix in horizontal and vertical directions, of pixels constituted by a set of display cells of three colors; the display controller may cause movement by units of the pixel arrayed in shape of matrix, as a display control to move and display the image through the image movement orbit; and movement from a current pixel to a next pixel includes a movement to a pixel adjacent to the current pixel in a horizontal or vertical direction.

According to another preferred embodiment of the present invention, an image display control method is provided, which executes a display control to display an image based on an input image signal on a displaying apparatus having a display screen, the image display control method including the step of: moving and displaying the image through an image movement orbit including at least an annular orbit having a central point of the image as a reference position which is used as a starting and returning point, and to repeatedly execute the image movement.

Also, such image display control method may have a plurality of annular orbits sharing the reference position sequentially selected, and the display control executed so that the image is moved and displayed through the selected annular orbit.

BRIEF DESCRIPTION OF THE DRAWINGS

The above and other objects and features of the present invention will become more readily apparent to those of ordinary skill in the art from the following detailed description taken in conjunction with the accompanying drawings in which:

FIG. 6 is a view showing an image movement pattern in the simulation example shown in FIG. 5;

DESCRIPTION OF PREFERRED EMBODIMENTS OF THE INVENTION

Figure 1:
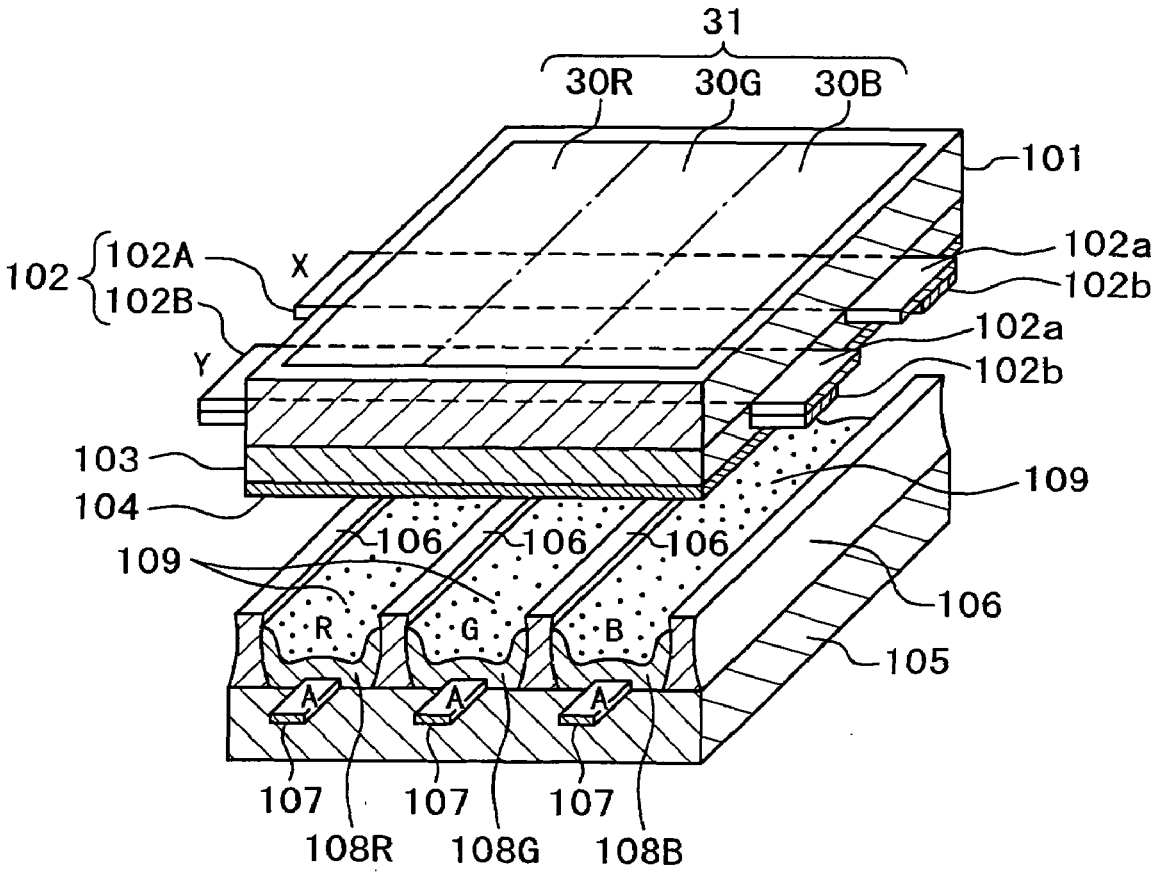
FIG. 1 is a perspective view showing a structure of a display panel of a plasma display apparatus as an embodiment of the present invention.

FIG. 1 shows a structure of a display panel of a plasma display apparatus to which an image display control apparatus as a preferred embodiment of the present invention is applied. By the way, as the plasma display apparatus as this embodiment, an AC type (an alternating current type) is listed as an example. As the display panel, the configuration of a surface discharging type by means of a three-electrode structure is employed.

As shown in FIG. 1, a transparent front glass substrate 101 is placed on the forefront of the display panel. Then, a sustaining electrode 102 composed of an electrode X (102A) and an electrode Y (102B), which serves as a pair, is placed on the rear side of this front glass substrate 101. The electrode X (102A) and the electrode Y (102B) are placed in parallel at a predetermined interval, for example, as shown in FIG. 1. The sustaining electrode 102 composed of the electrode X (102A) and the electrode Y (102B), which serves as this pair, forms a line as one column. Also, each of those electrode X (102A) and electrode Y (102B) is formed by the combination of a transparent conductive film 102*a* and a metal film (bus conductor) 102*b*.

On the rear side of the front glass substrate 101, the sustaining electrode 102 (the electrode X (102A) and the electrode Y (102B)) is placed as mentioned above, and a dielectric layer 103 made of, for example, low melting point glass is further placed thereon. A protective film 104 made of, for example, MgO and the like is formed on the rear side of this dielectric layer 103.

Also, on the front side of a rear glass substrate 105, an address electrode 107 is placed in a direction orthogonal to the sustaining electrode 102 (the electrode X (102A) and the electrode Y (102B)). The address electrode forms a line as a row. Also, a barrier rib 106 is formed between the address electrodes 107 adjacent to each other.

Then, fluorescent substance layers 108R, 108G and 108B of respective colors R, G and B are formed so as to be sequentially arrayed, so as to cover the rear glass substrate top surface sections on which the respective address electrodes 107 are placed and the side wall sections of the barrier ribs 106 on both sides thereof.

Under the above-mentioned structure, the front side end of the barrier rib 106 is actually fitted so as to contact with the protective film 104. Due to such structure, a discharge space 109 is formed in which the fluorescent substance layers 108R, 108G and 108B are formed. After this discharge space 109 is evacuated, gas, for example, such as neon (Ne), xenon (Xe), helium (He) and the like, is sealed therein.

Figure 2:
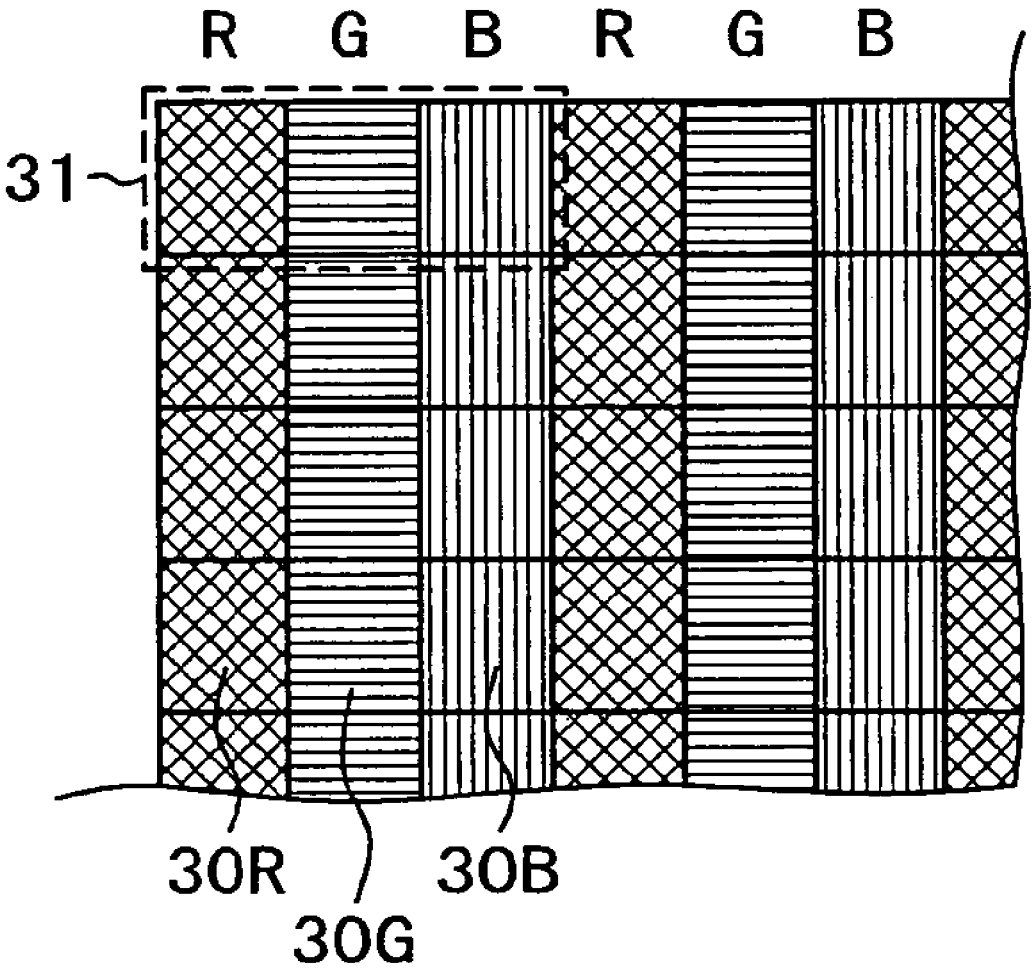
FIG. 2 is a view showing a relation between R, G and B cells in the display panel of the embodiment and pixels.

In such structure, the structure body portion of the display panel composed of the positions at which the sustaining electrode (the electrode X and the electrode Y) and the address electrode A cross is a cell 30. Then, in this cell, according to the structure of the display panel shown in FIG. 1, an R cell 30R, a G cell 30G and a B cell 30B are obtained on the basis of the colors of the correspondingly placed fluorescent substance layers 108, as shown in FIGS. 1, 2. Then, one pixel 31 that enables a color representation is constituted by the set of the cells 30R, 30G and 30B for R, G and B which are arrayed adjacently in an horizontal direction.

Figure 3:
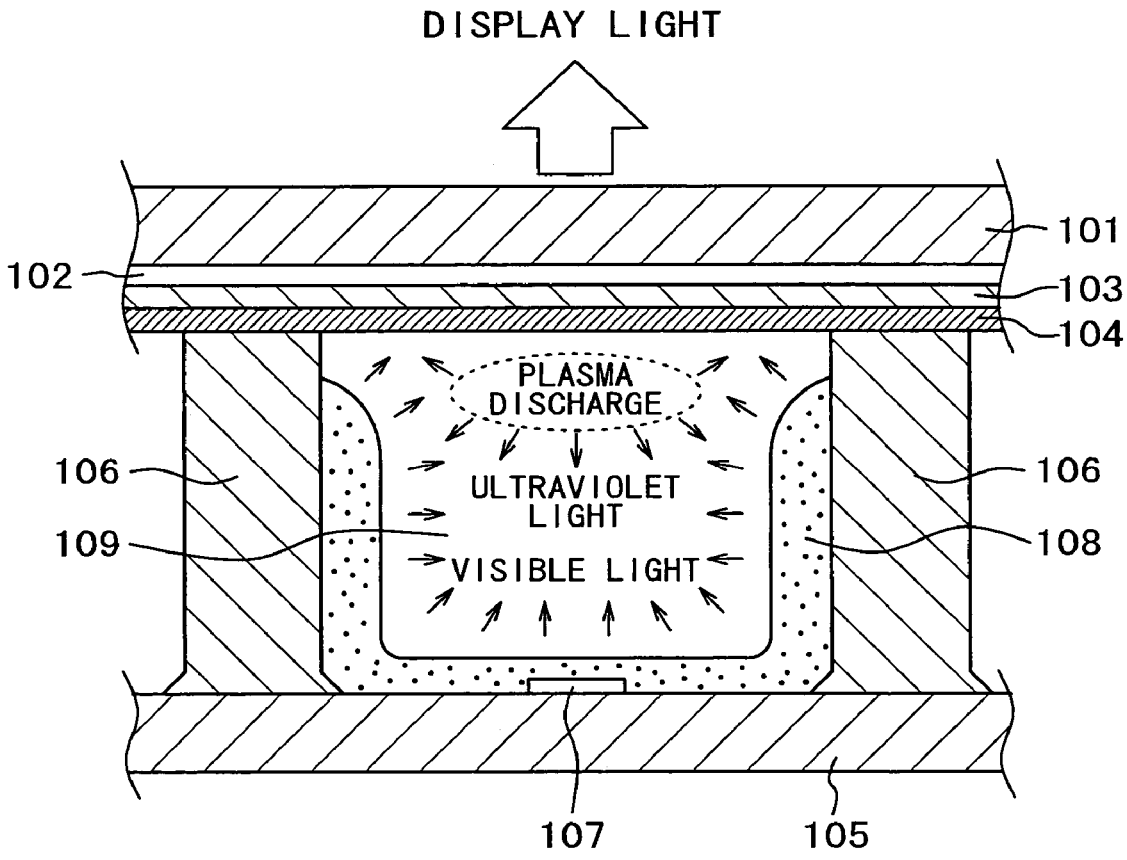
FIG. 3 is a sectional view of a display panel, to explain the displaying principle in the display panel of the embodiment.

Here, the light emission operation of the plasma display apparatus employing the display panel structure as this embodiment is explained with reference to FIG. 3. In FIG. 3, in the display panel having the structure as this embodiment, a section corresponding to one cell 30 is shown by the sectional view. By the way, in FIG. 3, the same symbols are given to the same portions as FIG. 1, and their explanations are omitted.

Although, the detailed explanations are omitted here, the display drive to be performed on the display panel having the structure shown in FIG. 1 is carried out by a so-called sub-field method. As is known, the sub-field method divides one sub-field into the predetermined number of sub-fields on which a binary weighting is performed, on the basis of the gradation number to be represented. Then, on the basis of the set gradation, the light emission drive is performed on the necessary cells in each sub-field.

In a certain sub-field period, the cell 30 on which the light emission drive is performed is designed so as to generate the surface discharge. This surface discharge is the plasma discharge in which the gas sealed in the discharge space 109 is at the plasma state, as shown in FIG. 3. Consequently, the ultraviolet radiations are radiated within the discharge space 109.

Then, in reaction to this irradiation of the ultraviolet radiations, the visible light is radiated from the fluorescent substance layer 108. This visible light is radiated in any color of R, G and B, correspondingly to which of the R fluorescent substance layer 108R, the G fluorescent substance layer 108G and the B fluorescent substance layer 108B is the actual fluorescent substance layer.

Then, this visible light is reflected by the fluorescent substance layer 108, and transmitted through the protective film 104, the dielectric layer 103 and the front glass substrate 101, and then irradiated as the display light to the front side.

By the way, the fluorescent substance layer 108 is deteriorated with age elapse because of the execution of the image display. Incidentally, the main factors of the deterioration in the fluorescent substance layer 108 are the ultraviolet rays (ultraviolet light) irradiated by the surface discharge within the discharge space 109 and the shock of the ionized gas, as explained in the conventional technique.

The deterioration in the fluorescent substance layer 108 appears as the drop in the brightness. Thus, if the fluorescent substance layer 108 in a fixed display region portion is further deteriorated as compared with the other regions, the difference of the brightness is induced between it and the circumferential display region. This difference results in the phenomenon of the so-called ghost. If the ghost is induced, for example, the ghost portion is viewed so as to overlap with the display image as the fixed pattern. Hence, this is not desirable because the quality of the display image is comprised.

So, the plasma display apparatus need to employ the configuration that can solve the deterioration in the display image quality caused by such ghost.

This preferred embodiment employs the pixel shift, as the method of reducing the above-mentioned ghost. The pixel shift moves the image at the image unit, with regard to the images to be displayed on the display screen of the display panel in the plasma display apparatus. Consequently, for example, the positions of the pixels (cells) displayed at the high brightness are shifted, which can suppress the progress of the deterioration in only the fluorescent substance corresponding to the particular pixel. This results in the reduction in the ghost.

Figure 4:
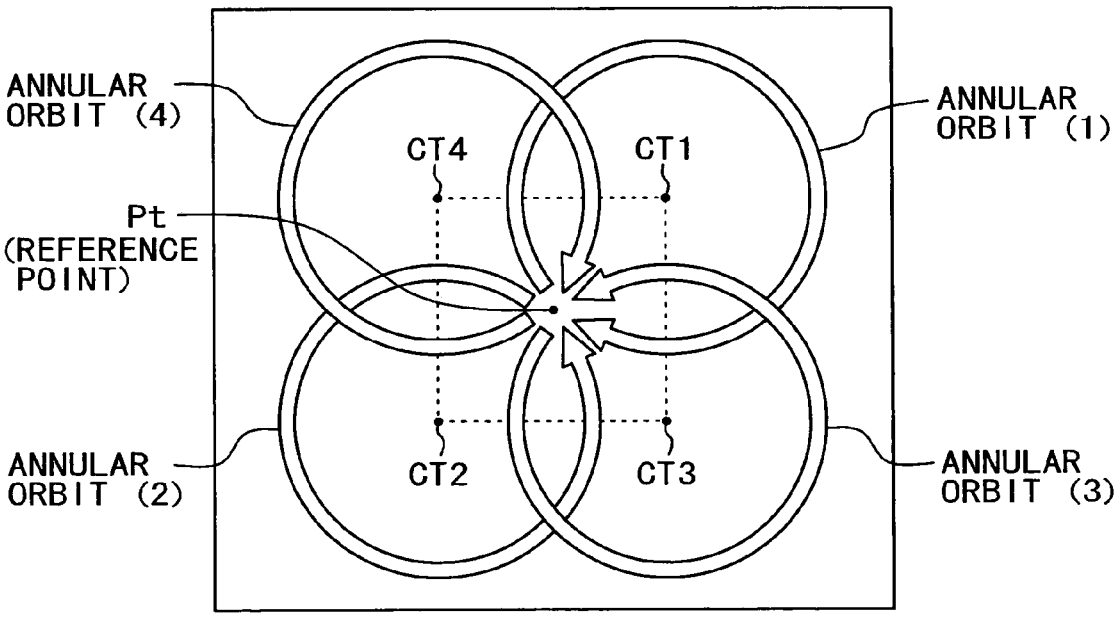
FIG. 4 is a view conceptually showing an orbit of an image movement as a pixel shift of the embodiment.

This embodiment sets the movement pattern of the image on the display screen, for the sake of the pixel shift, as shown in FIG. 4.

FIG. 4 diagrammatically shows the movement pattern of the image. FIG. 4 shows four annular orbits of annular orbits (1), (2), (3) and (4) as the orbits for the image movement. In other words, this embodiment has the quadruple annular orbit, as the orbit (the image movement orbit) corresponding to one round for the image movement. Then, this quadruple annular orbit has the following features.

Each of the four annular orbits has ideally an orbit of a circular shape, and their sizes of the circular shapes are equal to each other.

Also, those four annular orbits are designed such that each of them has a certain particular point on the display screen as a reference point Pt, this reference point Pt is assumed to be a start point, and after one round of the annular orbit, it always returns back to this reference point Pt.

Also, the positional relation on the display screen of those four annular orbits is defined as follows.

In other words, one annular orbit is located as the positional relation with the other three annular orbits, in such a way that another annular orbit is adjacently located in the right or left horizontal direction, still another annular orbit is adjacently located in the upper or lower vertical direction, and still another annular orbit is adjacently located off to the upper or lower direction at a 45-degree direction.

For example, when the annular orbit (1) is assumed to be standard, the annular orbit (4) among the remaining three annular orbits is located horizontally on the left side, adjacently to the annular orbit (1). The annular orbit (3) is located vertically on the lower side, adjacently to the annular orbit (1). And, the annular orbit (2) is located off to the lower left in a 45-degree direction, adjacently to the annular orbit (1).

Also, such positional relation can be defined as follows.

In other words, when the centers of the circular shapes of the respective annular orbits (1), (2), (3) and (4) are assumed to be CT1, CT2, CT3 and CT4, respectively, the square is formed in which they are the apexes. By the way, in this case, the annular orbits (1), (2), (3) and (4) are formed as the shape of a true circle. Thus, this square becomes the regular square. Then, those four annular orbits are arranged such that the set of the sides CT4-CT2 and the sides CT1-CT3 are vertical and the set of the sides CT4-CT1 and the sides CT2-CT3 are horizontal, in the two sets of the sides having the oppositely positional relation in this square (regular square). Alternatively, there may be two pairs of annular orbits which are in contact with each other, with the reference point Pt as the contact on a tangential line. It is said that those pairs of tangential lines are orthogonal to each other.

Also, the natural number within parentheses ( ) indicated as the annular orbits (1), (2), (3) and (4) indicates the selection order of the orbit for the image movement. In other words, when the image movement is started from the beginning, at first, with the reference point Pt as the start point, the image movement is started from the annular orbit (1). When the image movement corresponding to one round through this annular orbit (1) is ended, the image is located at the reference point Pt. In succession, it proceeds to the image movement corresponding to one round through the annular orbit (2) from the reference point Pt. Further, similarly, the image movement corresponding to one round through the annular orbit (3) from the reference point Pt and the image movement corresponding to one round through the annular orbit (4) are sequentially performed. Until this time, it makes one round of each of the annular orbits (1), (2), (3) and (4). This implies one cycle as the movement pattern of the image in this embodiment. When the movement of the image corresponding to this one cycle is ended, hereafter, the image movement corresponding to one cycle starting from the image movement corresponding to one round through the annular orbit (1) is repeated as mentioned above.

Figure 5:
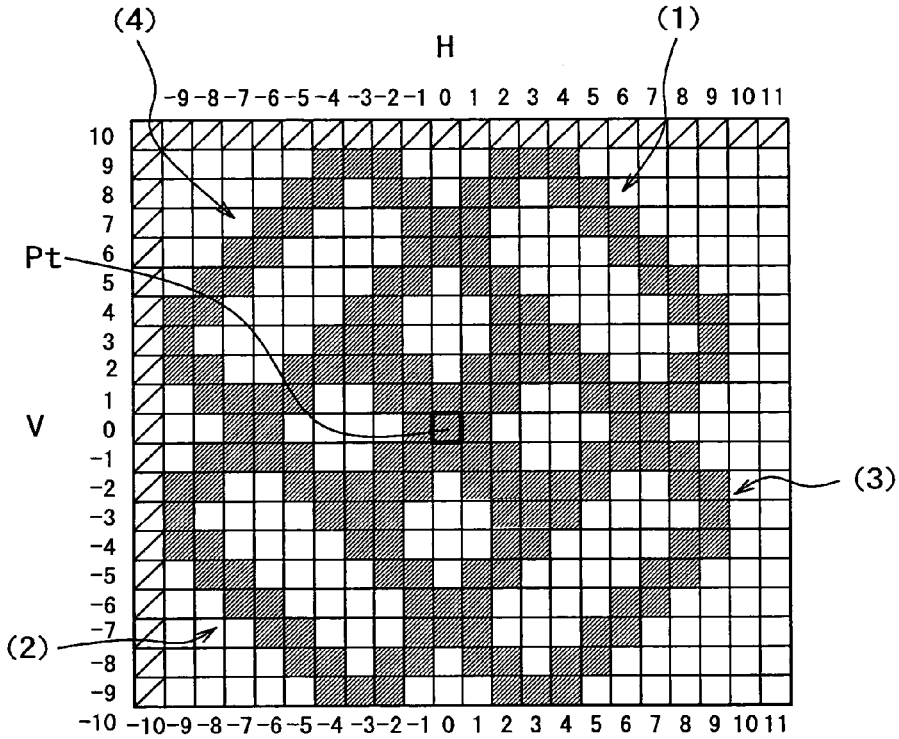
FIG. 5 is a view showing a simulation example of the orbit of the image movement shown in FIG. 4.

Then, as the simulation of the image movement pattern as this embodiment shown in FIG. 4, when the image movement is considered as the motion of one pixel in the entire image displayed on the plasma display apparatus, it can be illustrated, for example, as shown in FIG. 5.

By the way, also in this case, the image portion at the particular position corresponding to the pixel unit serving as the element constituting the image is referred to as the pixel correspondence image portion. Also, as the structure in the plasma display apparatus, for example, one pixel constituted by the set of the display cells of R, G and B is referred to as a display pixel.

In FIG. 5, the display pixels are arranged in the shape of the matrix, and they are indicated by the coordinates in horizontal (H) and vertical (Y) directions.

Here, let us suppose that the reference point Pt in FIG. 4 is the coordinates (0, 0). After that, the locus obtained by the execution of the movement between the display pixels of the pixel correspondence image portion in accordance with the concept shown in FIG. 4 is hatched and indicated on the coordinates of FIG. 5. In other words, this indicates the coordinates of the display pixel at which the pixel correspondence image portion is located by the movement. By the way, the reference point Pt assumed to be the coordinates (0, 0) is the central point on the display screen.

Then, the actual movement manner of the pixel correspondence image portion on this coordinate is as shown in FIG. 6. FIG. 6 shows the movement order of the entire quadruple annular orbits and the value of the coordinates (V, H) corresponding to the movement order, for each of the annular orbits (1), (2), (3) and (4).

According to FIG. 6, the movements corresponding to the 48 pixel correspondence image portions are carried out for each of the annular orbits (1), (2), (3) and (4). Thus, as the entire quadruple annular orbit after one cycle of the annular orbits (1), (2), (3) and (4), the movement is done correspondingly to the 196 (=48×48) pixel correspondence image portions. Also, each of the actual annular orbits in this case is designed so as to represent the shape close to a rhomb whose four sides are equal.

Also, the movement of the annular orbit (1) starts from the coordinates (V, H)=(0, 0) and ends at the coordinates (−1, 0). The movement of the annular orbit (2) following it starts from the coordinates (0, 0) and ends at the coordinates (0, −1). The movement of the next annular orbit (3) starts from the coordinates (0, 0) and ends at the coordinates (1, 0). And, the movement of the final annular orbit (4) starts from the coordinates (0, 0), and ends at the coordinates (0, 1).

In other words, any movement of the annular orbits (1), (2), (3) and (4) starts from the coordinates (0, 0) corresponding to the reference point Pt, and finally arrives at the coordinates located adjacently to the coordinates (0, 0), in any of the upper, lower, right and left directions. That is, this implies that each movement of the annular orbits (1), (2), (3) and (4) always starts with the reference point Pt as the start point, and returns back to the reference point Pt, at the end of the movement corresponding to one round.

In this way, all of the annular orbits constituting the quadruple annular orbit have the orbit which uses the reference point Pt as the start point and returns back thereto. So, this embodiment is designed such that this reference point Pt is set at the position of the display pixel at which the pixel correspondence image portion is originally displayed, on the display screen, when the pixel shift is not performed. If this setting is done, when the movement of the image is done for the sake of the pixel shift, each time the movements based on the respective annular orbits are started and ended, it is returned back to the position situation to be originally displayed on the display screen.

Figure 14A:
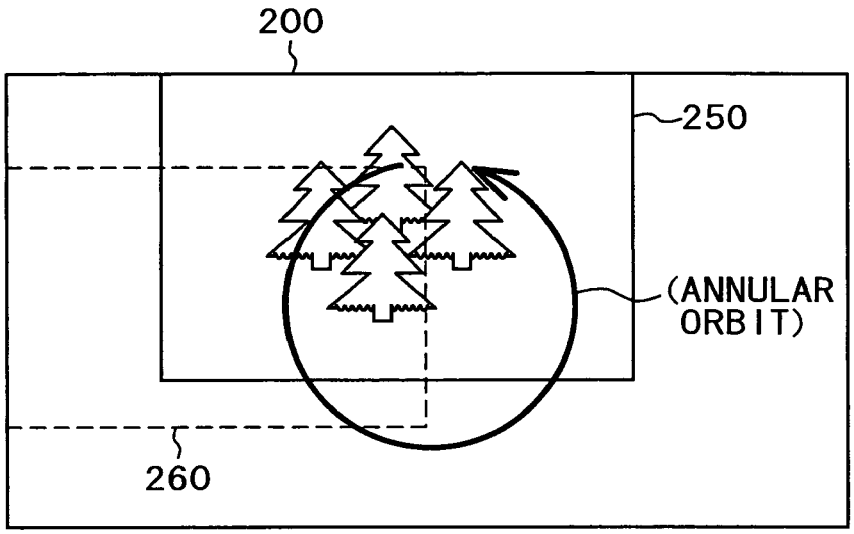
FIG. 14A (PRIOR ART)
FIGS. 14A, 14B are views showing an orbit of an image movement as the pixel shift, in a conventional technique.
Figure 14B:
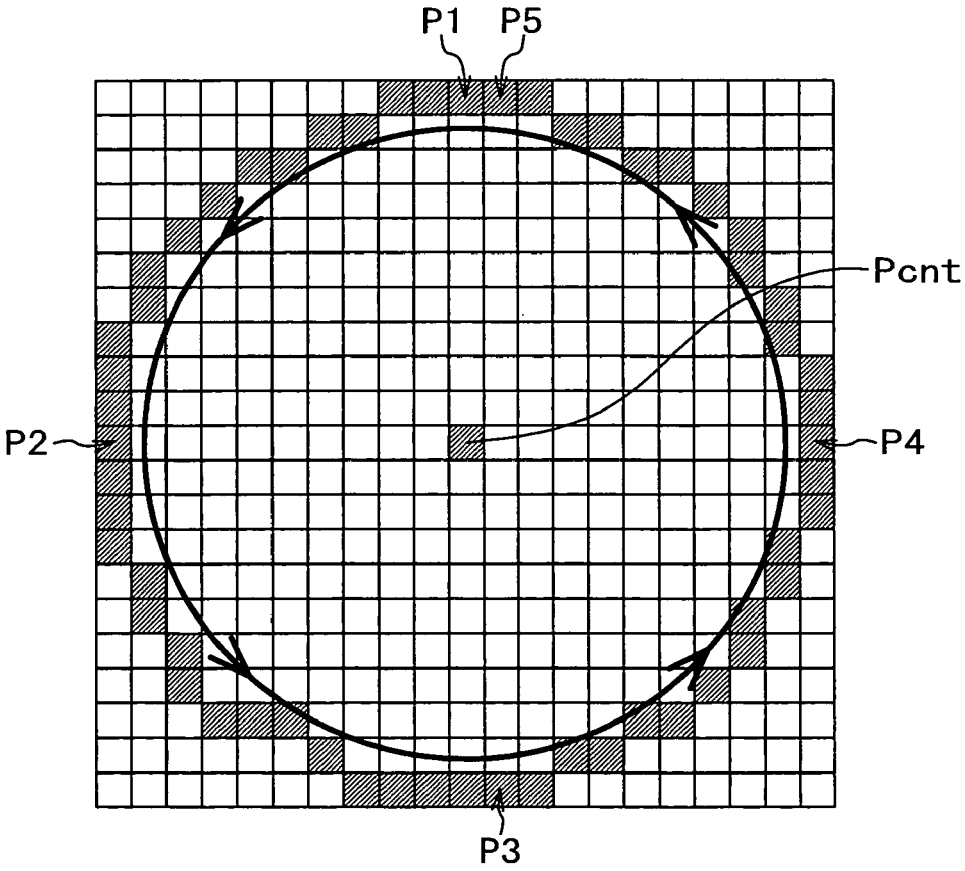
FIG. 14B (PRIOR ART)

Consequently, for example, under the condition of the same movement amount, when the case of moving the image through the single annular orbit as illustrated in FIGS. 14A, 14B and the case of moving the image through the quadruple annular orbit in this embodiment are compared with each other, the fact of the image movement in this embodiment is harder to be visually recognized. Also as the actual experimental result, it can be confirmed that the visual recognition of the image movement is considerably low.

From this fact, the image movement through the quadruple annular orbit as this embodiment can be steadily done during the image display. In other words, depending on the quadruple annular orbit in this embodiment, even if the image movement is steadily done, the fact of the image movement is hard to be visually recognized to a degree that uncomfortable feeling is not sensed by a person who views it.

Consequently, the effect of the reduction in the ghost is further increased. Also, although a concrete example will be described later, due to the establishment of the certain time interval and the judgment of the static image, there is no necessity of starting the image movement as the pixel shift. Thus, there is no necessity of adding the configuration as the hardware and software required to control it.

Also, in this embodiment, the following rule of the image movement is defined, thereby making the visual recognition as the image movement lower.

Figure 7A:
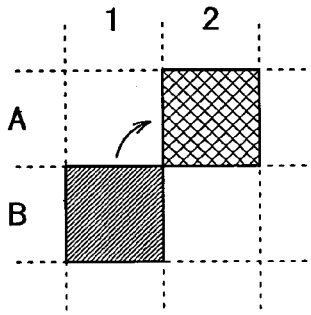
FIGS. 7A, 7B, 7C, 7D and 7E are views showing a distribution of an occurrence probability of pixel correspondence image portions corresponding to the simulation example shown in FIG. 5.

FIG. 7A picks up and shows a part of the display pixels arranged in the shape of the matrix. Here, let us suppose that the pixel correspondence image portion is currently located at a display pixel (B, 1). Then, the case is considered in which the pixel correspondence image portion located at this display pixel (B, 1) becomes a display pixel (A, 2) located off to the upper right of the display pixel (B, 1), as shown in FIG. 7A, supposing that the pixel correspondence image portion is simply moved in accordance with the set annular locus.

Figure 7B:
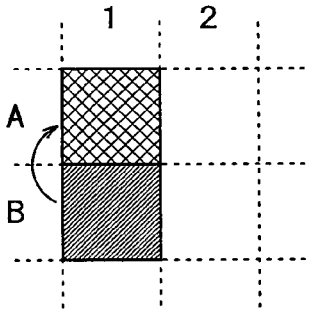
Figure 7D:
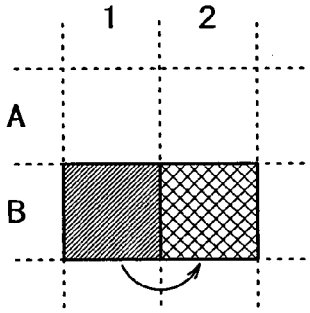
Figure 7C:
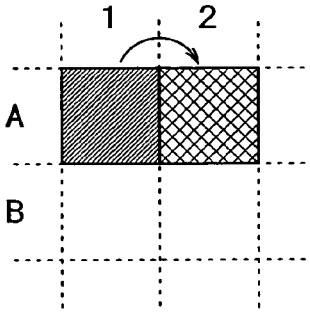
Figure 7E:
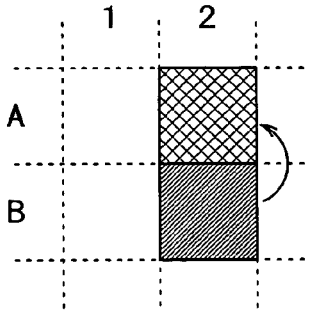

From the actual test result, as shown in FIG. 7A, when the pixel correspondence image portion is moved between the display pixels having the relation in which they are oblique and adjacent to each other, namely, when the image is merely moved in the oblique direction at the pixel unit, it is confirmed that the image movement is visually outstanding So, this embodiment carries out, for example, a procedure shown in FIGS. 7B to 7C or a procedure shown in FIG. 7D to 7E, if there is the necessity of obliquely moving the pixel correspondence image portion, in the case along the annular locus from the display pixel (B, 1) to the display pixel (A, 2), for example, as shown in FIG. 7A.

At first, the procedure shown in FIGS. 7B to 7C is explained. Firstly, as shown in FIG. 7B, the pixel correspondence image portion located at the display pixel (B, 1) is moved to the display pixel (A, 1) immediately on it. In succession, the pixel correspondence image portion located at the display pixel (A, 1) is moved to a display pixel (A, 2) located right adjacent to it. Consequently, the pixel correspondence image portion located at the display pixel (B, 1) is moved to the display pixel (A, 2).

Or, as shown in FIG. 7D, the pixel correspondence image portion located at the display pixel (B, 1) is moved to the display pixel (B, 2) located immediately right adjacent to it. Then, the pixel correspondence image portion located at this display pixel (B, 2) is moved to the display pixel (A, 2) located immediately on it. Even based on this manner, the pixel correspondence image portion located at the display pixel (B, 1) can be moved to the display pixel (A, 2).

In other words, in this embodiment, if there is the necessity of moving the pixel correspondence image portion to the display pixel (the display pixel (A, 2)) located in the oblique direction from the current pixel position (the display pixel (B, 1)), it is not directly moved to this oblique display pixel. Then, the procedure is firstly executed for moving the pixel correspondence image portion to the display pixel (the display pixel (A, 1) or (B, 2)), which is adjacent to the current display pixel position in any of the upper, lower, right and left directions and also adjacent to even the targeted display pixel located in the oblique direction from the current display pixel position, in any of the upper, lower, right and left directions. From here, this procedure further moves the pixel correspondence image portion to the targeted display pixel (the display pixel (A, 2)) which is located at the position adjacent to any of the upper, lower, right and left directions.

In other words, in this embodiment, the movement from a certain display pixel to a next display pixel is not done in the oblique direction, and it is always done in the upper, lower, right and left directions. In this way, when the image movement is limited to only the upper, lower right and left (horizontal/vertical) directions, it can be confirmed from the test that the visual recognition of the image movement can be greatly reduced over the case of involving the oblique movement.

Then, even by referring to the moving manner of the quadruple annular orbit already shown in FIG. 6, as mentioned above, it can be confirmed that the movement of the pixel correspondence image portion between the display pixels is limited to the upper, lower right and left (horizontal/vertical) directions.

Also, the image movement through the quadruple annular orbit as this embodiment can provide the effect that is excellent in the reduction in the ghost, as compared with the image movement through the single circular orbit of the related art, for example, as shown in FIGS. 14A, 14B.

This point will be explained below by again referring to FIG. 5 and also referring to FIG. 8.

FIG. 5 shows the transition of the movement of one pixel correspondence image portion, on the display pixels arranged in the shape of the matrix, as the image movement example (the simulation result) through the quadruple annular orbit in this embodiment, as can be understood from the previous explanation.

In FIG. 5, the lower side, on which the matrix of the display pixels are represented, indicates the number of occurrences, namely, occurrences in which not only the outer circumference of the annular orbit but also the inner white portions are included, of the pixel correspondence image portions at the horizontal (H) coordinate corresponding to each round of the respective annular orbits (1), (2), (3) and (4), as the result of the movement of the pixel correspondence image portion. Also, it shows the total number of the occurrences in which the number of the occurrences of the pixel correspondence image portions for each of those annular orbits (1), (2), (3) and (4) is similarly added to each horizontal coordinate. Thus, the total number of the occurrences indicates the number of the occurrences of the pixel correspondence image portions on the horizontal coordinate, in the case of one cycle of the quadruple annular orbit, as the simulation result shown in FIG. 5.

In the simulation shown in FIG. 5, the pixel correspondence image portion is moved 192 times in one cycle of the quadruple annular orbit, as shown in FIG. 6. From this fact, if the simulation shown in FIG. 5 is performed, the occurrence probability of the pixel correspondence image portions for each horizontal coordinate is represented by the total number of the occurrences/192. FIG. 8 shows the relation between the horizontal coordinate obtained by this communication and the occurrence probability.

Figure 8:
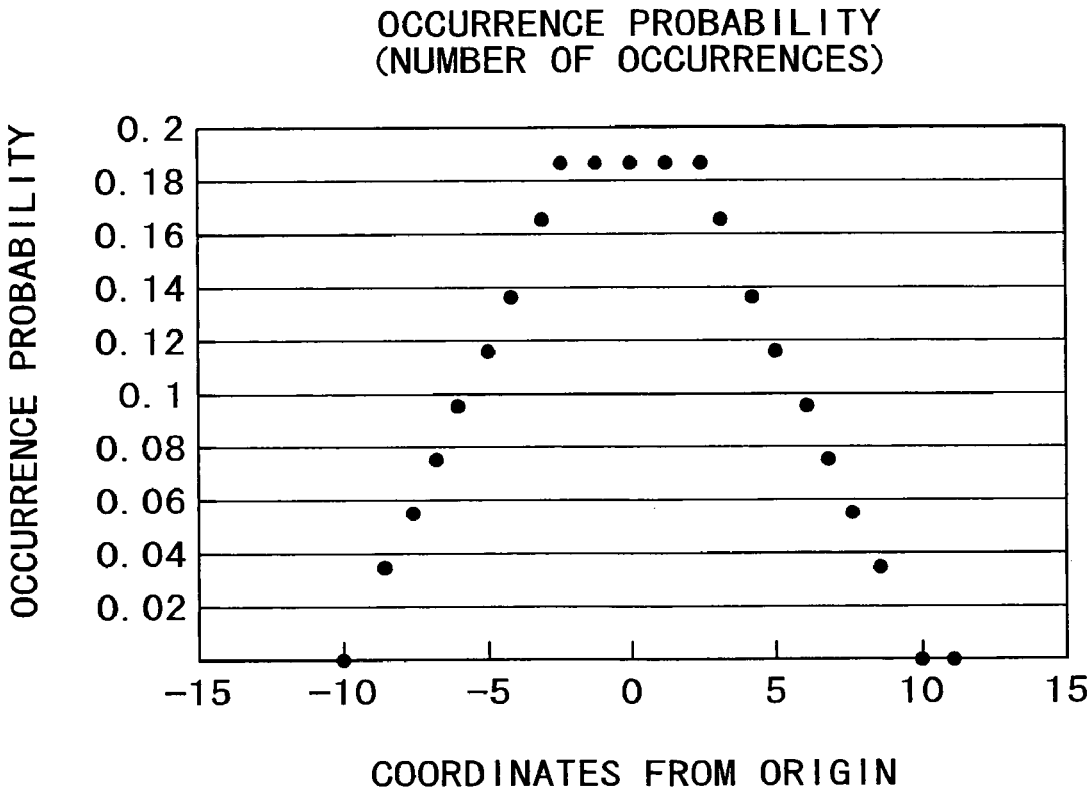
FIG. 8 is a view showing a movement rule between display pixels adjacent to each other, as the movement pattern of the pixel correspondence image portion.

In FIG. 8, the lateral axis indicates the horizontal coordinate, and the longitudinal axis indicates the occurrence probability. In other words, it indicates the occurrence probability (the total number of the occurrences/192) for each horizontal coordinate shown in FIG. 5.

According to FIG. 8, the occurrence probability of the pixel correspondence image portions of the horizontal coordinates exhibits the following tendency. That is, there are the peaks in the vicinity of the origin of the horizontal coordinates. Also, as the horizontal coordinates go away from the origin in the positive and negative directions, it is changed so as to be symmetrical with respect to the origin and linearly reduced.

By the way, the total number of the occurrences obtained on the basis of the movement patterns of the pixel correspondence image portions viewed from the vertical (H) coordinates becomes similar to the relation between the horizontal coordinate and the total number of the occurrences shown in FIG. 5. Thus, the occurrence probability in the vertical coordinates can be indicated by replacing the horizontal axis of FIG. 8 with the vertical coordinates.

Then, the followings can be said from the result of the occurrence probability as mentioned above.

Here, if the pixel correspondence image portion is assumed to be displayed at the brightness level close to the white which progresses the ghost, the ghost is correspondingly easily progressed at the coordinate having the higher occurrence probability. On the contrary, as the occurrence probability becomes lower, the ghost is harder to be progressed.

So, when both of the horizontal coordinate and the vertical coordinate are considered as the occurrence probability shown in FIG. 8, the ghost progresses most severely in the range of about 5×5 display pixels including the origin. Outside this range, as it goes away from the origin, the progress of the ghost is reduced.

Thus, the pattern of the ghost is obtained in which the degree of the ghost is gradually weak from the center to the outside. This implies that the boundary between the portion where the ghost is induced and the portion where it is not induced is not clear. Even in the case of the ghost of the similar degree, if the boundary of the region where the peripheral ghost is not induced is clear, the ghost is correspondingly outstanding. However, as it becomes unclear, the ghost is not visually outstanding on the basis of the unclearness.

In other words, as the occurrence probability of the image obtained from the quadruple annular orbit in this embodiment, the result shown in FIG. 8 is obtained so that the ghost is not visually outstanding. That is, it is said to obtain the ghost reduction effect which is higher than that of the conventional technique.

Also, from the viewpoint of this ghost reduction effect, the followings are considered in the quadruple annular orbit as this embodiment.

As shown in FIGS. 4 and 5, the respective positional relations of the four annular orbits constituting the quadruple annular orbit in this embodiment were explained such that "an annular orbit is located as the positional relation with the other three annular orbits, in such a way that another annular orbit is adjacently located in the right or left horizontal direction, still another annular orbit is adjacently located in the upper or lower vertical direction, and still another annular orbit is adjacently located off to the upper or lower direction at the 45-degree direction".

Figure 9:
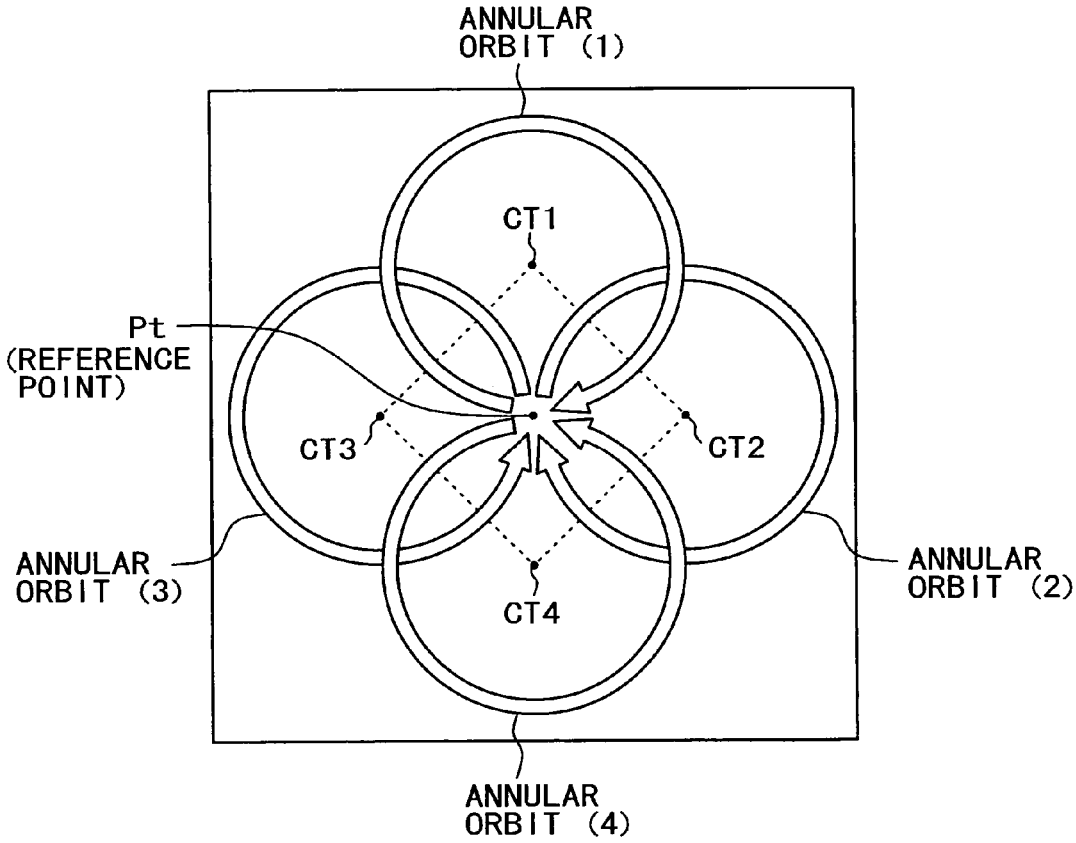
FIG. 9 is a view showing another example of the orbit of the image movement on the basis of a concept of the present invention.

Here, when another implementation is considered as the positional relation of the four annular orbits constituting the quadruple annular orbit based on the present invention, the mechanism shown in FIG. 9 may be considered. That is, the entire quadruple annular orbit shown in FIG. 4 is rotated by 45 degrees.

Figure 10:
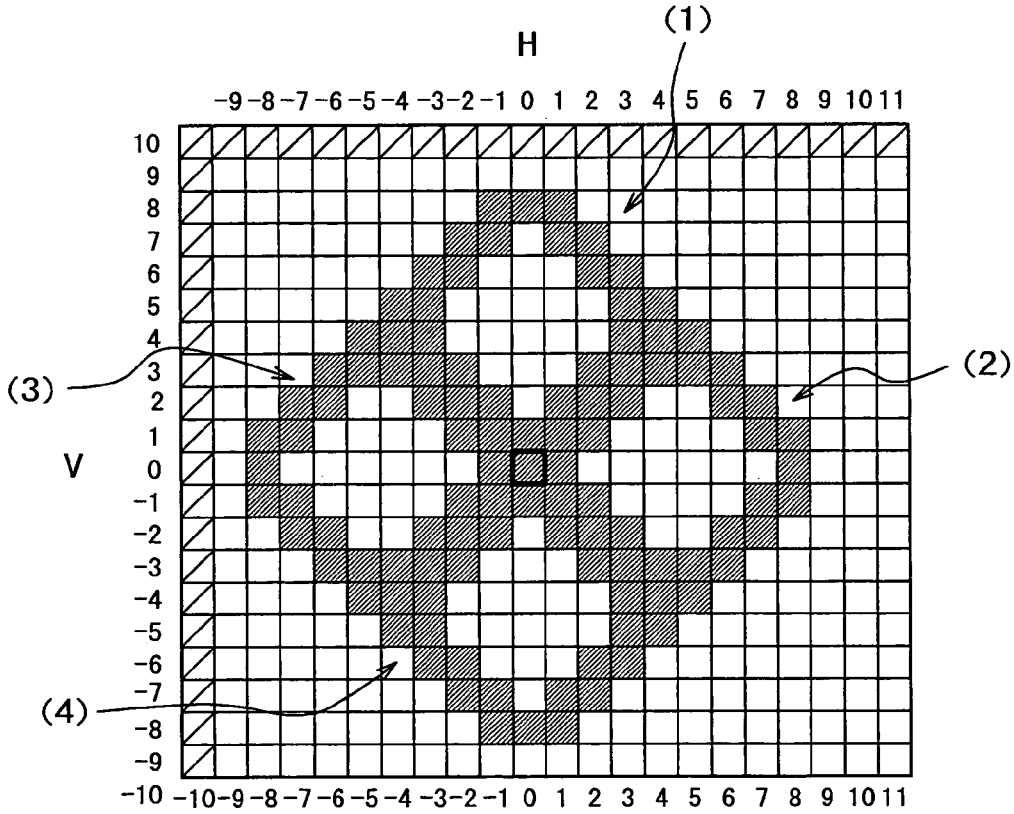
FIG. 10 is a view showing a simulation example of the orbit of the image movement shown in FIG. 9.

FIG. 10 shows the simulation result of such case. In FIG. 10, similarly to the case already shown in FIG. 5, as for the image movement, the movement of the entire image displayed on the plasma display apparatus is considered to be the motion of one pixel correspondence image portion. Also, the movement between the display pixels through this quadruple annular orbit is based on the rule explained in FIGS. 4, 5, 6 and 7. Thus, the selection order of the respective annular orbits in the quadruple annular orbit becomes the annular orbits (1)→(2)→(3)→(4). In each of the annular orbits, for example, the reference point Pt is defined as the start point, and it returns back thereto. In addition, the movement pattern between the display pixels shown in FIG. 6 is applied. Moreover, as shown in FIG. 7, the direct movement to the oblique display pixel is not done, and the movement to the adjacent display pixel in the horizontal or vertical direction is always done. In other words, the quadruple annular orbit of the embodiment shown in FIGS. 4, 5 and the quadruple annular orbit shown in FIGS. 9, 10 are equal in the condition with regard to the movement rule pattern and then different in the positional relation between the respective annular orbits.

Then, as the result of the simulation shown in FIG. 10, here, it also indicates the number of the occurrences of the pixel correspondence image portions in the horizontal (H) coordinates corresponding to each of one cycle of the respective annular orbits (1), (2), (3) and (4). Also, it indicates the total number of the occurrences in which the numbers of the occurrences of the pixel correspondence image portions for each of those annular orbits (1), (2), (3) and (4) are similarly added to each of the horizontal coordinates.

Then, the simulation shown in FIG. 10 is the movement pattern in which the pixel correspondence image portion is moved 30 times for each round of the annular orbits (1), (2), (3) and (4). Thus, in one cycle of the quadruple annular orbit, the pixel correspondence image portion is moved 120 times. For this reason, the occurrence probability of the pixel correspondence image portions for each horizontal coordinate is represented by the total number of the occurrences/120. From this calculation, the property indicating the relation between the horizontal coordinate and the occurrence probability is indicated in FIG. 11.

Figure 11:
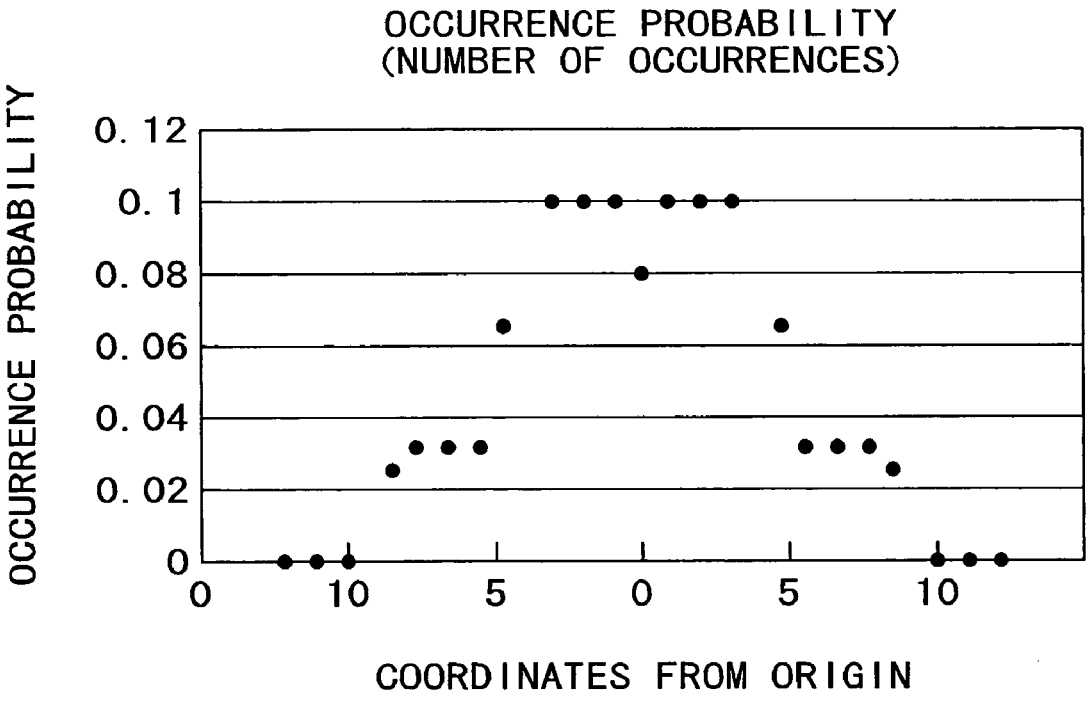
FIG. 11 is a view showing a distribution of an occurrence probability of pixel correspondence image portions corresponding to the simulation example shown in FIG. 10.

According to FIG. 11, for example, the positive direction of the horizontal coordinates exhibits the tendency that the occurrence probability becomes lower as the coordinate value is increased from the origin. However, it is known that the occurrence probability is gradually reduced without being linearly reduced so as to be proportional to the increase in the coordinate value. In other words, the occurrence probability is extremely changed between the coordinates adjacent to each other. By the way, even the negative direction of the horizontal coordinates exhibits the tendency equal to that of the positive direction of the horizontal coordinates as mentioned above, symmetrically with respect to the origin.

In this way, the fact that the tendency of the reduction in the occurrence probability corresponding to the increase in the absolute value of the coordinate with the origin as a standard becomes gradually implies that the difference of the number of the accumulation light emissions becomes relatively great at the position on the display screen that is the boundary in which this occurrence probability is gradually changed. The fact that the difference of the number of the accumulation light emissions is relatively great brings about the easy induction of the ghost in the boundary where this occurrence probability is gradually changed.

On the contrary, this embodiment exhibits the property that as already shown in FIG. 8, as the horizontal coordinate goes away from the origin, the value of the occurrence probability is linearly dropped from the situation in which a certain degree of peaks are continuous. In other words, there is no problem of the ghost induction on the boundary between the coordinates where the occurrence probability is gradually changed, as mentioned above.

Moreover, also in the property shown in FIG. 11, the peaks at about 0.1 are continuous in the vicinity of the origin. However, as for only the origin, it has the value (about 0.08) of the occurrence probability that is extremely lower than the peak. Even in such a probability distribution, there is the extreme difference in the occurrence probability between the coordinates adjacent to each other, which easily induce the ghost effect. Thus, this is not desirable. On the contrary, in this embodiment, as can be also known from FIG. 8, in the range in which the peaks in the vicinity of the origin are continuous, there is not the situation in which only a certain coordinate has the extremely different value, and they are about 0.183 and uniform. In other words, in this range, a uniform ghost range can be obtained, which makes the ghost inconspicuous.

In succession, the configuration of the plasma display apparatus is described which employs the pixel shift through the quadruple annular orbit as this embodiment.

Figure 15:
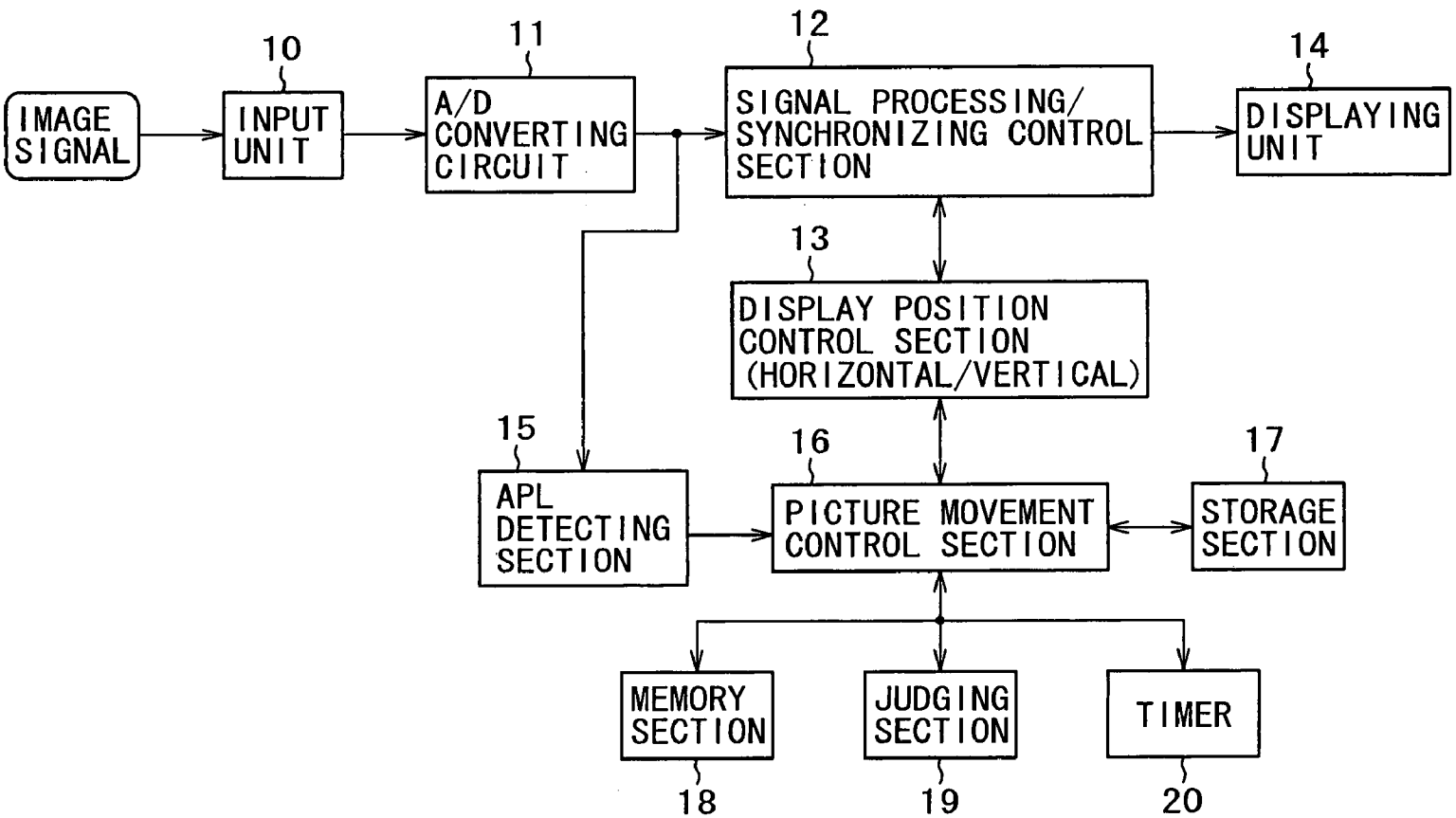
FIG. 15 (PRIOR ART)
FIG. 15 is a block diagram showing a configuration example of a plasma display apparatus as the conventional technique.

FIG. 15 shows the configuration example of the plasma display apparatus based on the content described in Japanese Laid Open Patent Application (JP-A-H08-248934).

An input analog image signal is inputted to, for example, an input unit 10. Here, a signal process at a predetermined input stage, for example, such as a gamma correction, is performed, and it is inputted to an A/D converting circuit 11.

The A/D converting circuit 11 converts the input analog image signal from the input unit 10 into a digital image signal, which is inputted to a signal processing/synchronizing control section 12. Also, it is branched and inputted to an APL detecting unit.

The signal processing/synchronizing control section 12 performs the various processes necessary for the image display in a displaying unit 14, such as a synchronization separation, a color demodulation and the like, on the input digital image signal. Also, a display position control section 13 controls the display position of the image to be displayed on the displaying unit 14, for example, in accordance with a synchronization signal inputted from the signal processing/synchronizing control section 12 and the like. The signal processing/synchronizing control section 12 drives the displaying unit 14, for example, based on the sub-field method, in accordance with the control of the display position control section 13. Consequently, the image is displayed at the reasonable display position on the displaying unit 14.

Also, in the plasma display apparatus, a PLE (Peak Luminance Enhancement) control is performed as is well known. Simply explaining, the PLE control detects, for example, an average brightness level of the image signals corresponding to the entire field screen, and sets a display brightness level to actually display the image, in accordance with this average brightness level. Then, so as to represent the gradation based on this set display brightness level, the drive based on, for example, the above-mentioned sub-field is performed. The actual PLE control sets the display brightness level high, for the image whose average brightness level is low and dark, and performs the display of the high brightness thereon. On the contrary, for the image whose average brightness level is high and bright, it sets the display brightness level low, and limits the brightness.

The execution of the PLE control as mentioned above reduces the maximum electric power consumption when the image signal having the high average brightness level is displayed as the image, and also enables the image which is excellent in contrast to be displayed.

This PLE control is also executed by the signal processing/synchronizing control section 12, in FIG. 15.

Hereafter, FIG. 15 explains the configuration for carrying out the pixel shift in order to reduce the ghost.

For example, in the conventional pixel shift, as shown in FIGS. 14A, 14B, the image is moved through the single circular orbit. Moreover, this orbit does not return back to the reference point of the image. Thus, the image movement as the pixel shift is relatively outstanding. For this reason, it is designed to employ the configuration for intermittently executing the image movement in accordance with the predetermined condition without steadily executing it. The following explanation is related to the configuration for attaining such an intermittent image movement.

In FIG. 15, an APL detecting section 15 detects, for example, the average brightness level of the image signals for each field, for example, in accordance with the input digital image signal from the A/D converting circuit 11, and outputs to an image movement control section 16.

The image movement control section 16 is the device for executing the control for the image movement operation as the pixel shift, which will be described later. The image movement control section 16 transfers the information of the average brightness level for each field period inputted from the APL detecting section 15 to a memory section 18, which stores the information. Then, it further reads out this information of the average brightness level and inputs to a judging section 19. Next, it compares the average brightness level, which is written to and stored in the memory section 18, with the average brightness level of the earlier field, which is inputted to the judging section 19 and then judges whether or not there is the difference.

Then, if the judgment result implying that there is no difference is obtained as the judgment result, a timer 20 starts a clocking operation. Then, the image movement control section 16, if recognizing that the judgment result implying the difference as the judged result by the judging section 19 is not outputted until the elapse of a predetermined time as the clocked time by the timer 20, reads in a program for the image movement as the pixel shift, which is stored in a storage section 17. By the way, this program is the program to move the image through the single annular orbit (the circular orbit) as explained in FIGS. 14A, 14B.

The image movement control section 16 executes the control for moving the image, in accordance with the program for this image movement. In other words, the image movement control section 16 indicates to the display position control section 13, the display position of the image in the horizontal/vertical directions, so as to carry out the image movement explained in FIGS. 14A, 14B. The display position control section 13 controls the driving process for the displaying unit 14 in the signal processing/synchronizing control section 12, so as to attain the indicated display position of the image. Consequently, the image movement as the pixel shift is started, for example, as illustrated in FIGS. 14A, 14B.

This configuration shown in FIG. 15 employs the configuration for starting the pixel shift, when there is no difference in the average brightness between the temporally earlier and later fields, namely, when the situation that there is no change in the image is continuous for a certain time or more. The fact that there is no change in the displayed image implies the situation that the ghost is easily induced in the portion where the brightness difference in its image is large. So, this configuration contrives the good way so that in such situation, the execution of the pixel shift, even if it is the intermittent pixel shift, efficiently reduces the ghost.

Figure 12A:
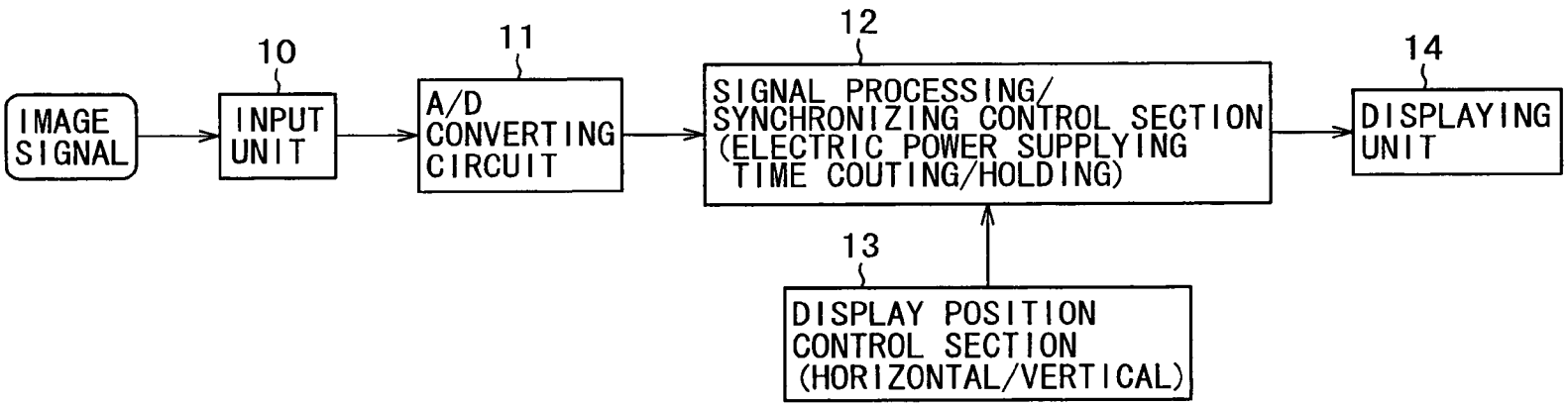
FIGS. 12A, 12B are block diagrams showing a configuration example of the plasma display apparatus as the embodiment.

The plasma display apparatus corresponding to this embodiment can be configured as shown in FIG. 12A. By the way, in FIG. 12A, the same symbols are given to the same members as those of FIG. 15.

Also in the plasma display apparatus in this embodiment, the analog image signal is firstly inputted to the input unit 10, and the necessary signal processes such as the gamma correction and the like are performed thereby. After that, it is converted into the digital image signal by the A/D converting circuit 11 and inputted to the signal processing/synchronizing control section 12.

This signal processing/synchronizing control section 12 also executes the synchronizing control for the displaying, in accordance with the synchronization signal separated from the input digital image signal, and executes the necessary signal processes such as the color demodulation and the like.

Then, the display position of the image is set by the control of the display position control section 13, and the displaying unit 14 is driven, for example, in accordance with the subfield method. The displaying unit in this case is composed of the panel having the structure, for example, shown in FIG. 1, the driver for driving the electrode group placed in this panel, and the like. The display position control section 13 controls the display position of the field image to be displayed on the displaying unit 14, at a pixel (cell) unit, in accordance with the display drive of the signal processing/synchronizing control section 12. To do so, the control is executed, for example, in such a way that the data to be inputted to the driver (shift register) for driving the electrodes of the display panel in the displaying unit is shifted on the basis of the position of the image to be displayed.

Here, as this embodiment, if it is designed so as to steadily carry out the image movement through the quadruple annular orbit, for example, as shown in FIG. 4, the display position control section 13 can be configured from the beginning under the assumption that the image movement is carried out by the repetition of the pattern of this image movement. Thus, the display position control section 13 in this case need not load the program of the movement pattern, for example, for the pixel shift, one by one. Hence, the memory section for storing the program for the image movement, for example, as shown in FIG. 15 is not required.

Also, it is not necessary to control the start timing of the image movement as the pixel shift. Thus, the APL detecting section 15, the control section 16, the memory section 18, the judging section 19 and the timer 20 may be omitted.

Consequently, the configuration shown in FIG. 12 is simpler than that of FIG. 15.

By the way, as shown in FIG. 12A, the signal processing/synchronizing control section 12 executes the process for the energized time counting/holding.

The plasma display apparatus in the present situation typically has the configuration for counting and holding an accumulated energized time. The accumulated energized time in this case implies the total energized time (namely, the time while the main power source is on) until the current time in the plasma display apparatus. The energized time counting/holding process of the signal processing/synchronizing control section 12, for example, if the main power source is turned on, counts the energized time from this time. Then, when the main power source is turned off, the counting is ended. Then, for example, the energized time obtained by the counting at this time is added to the accumulated energized time stored in a non-volatile memory region contained by the signal processing/synchronizing control section 12, and it is updated.

Here, moreover, in view of the further increase in the ghost reduction effect, for example, when the power source is on and when the image movement through the quadruple annular orbit as this embodiment is started, for example, it is desired that the annular orbit to be firstly selected is random. This is because since the occurrence probability of the pixel correspondence image portions on the display screen is further dispersed and distributed when it is considered in a longer time, the ghost is further harder to be induced.

Figure 12B:
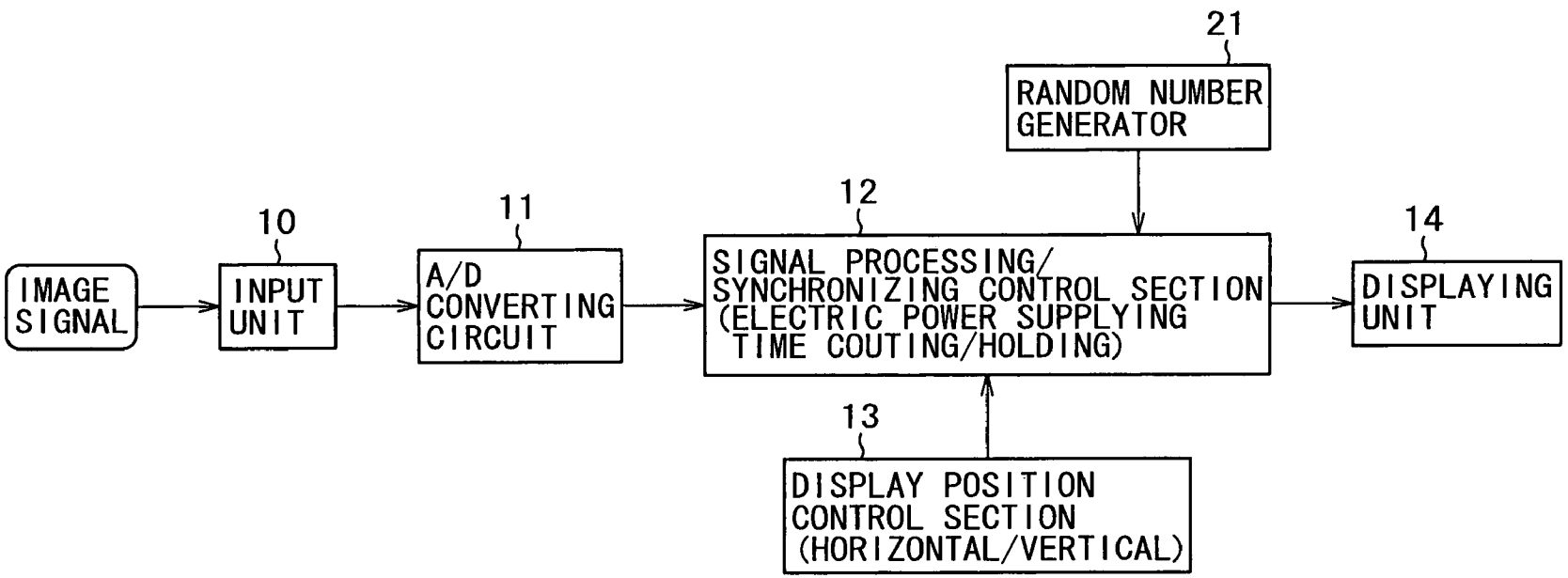

So, as the configuration for this attainment, for example, it may be considered to include a random number generator shown in FIG. 12B. In other words, when the power source is turned on, the random number generator firstly generates a random number, and selects any two annular orbits from the four annular orbits constituting the quadruple annular orbit, in accordance with the value of the generated random number. Then, the image movement is started from this selected annular orbit.

Alternatively, the following configuration may be considered.

As explained in FIG. 12A, the plasma display apparatus typically has the configuration for counting and holding the accumulated energized time. So, this embodiment can be designed so as to use, as the random number, the value of the accumulated energized time stored in the plasma display apparatus as mentioned above, and then select the annular orbit in starting the image movement, in accordance with the value of the accumulated energized time held when the power source is turned on. Such configuration does not require the additional installation of the random number generator, and merely uses the already-mounted configuration for counting/holding the accumulated energized time.

The process for selecting the annular orbit in accordance with the value of the accumulated energized time as mentioned above will be described below with reference to FIG. 13. The process shown in FIG. 13, if it is configured, for example, as shown in FIG. 12A, may be executed by the jointed operation of the display position control section 13 and the functional member for the energized time counting/holding in the signal processing/synchronizing control section 12.

Figure 13:
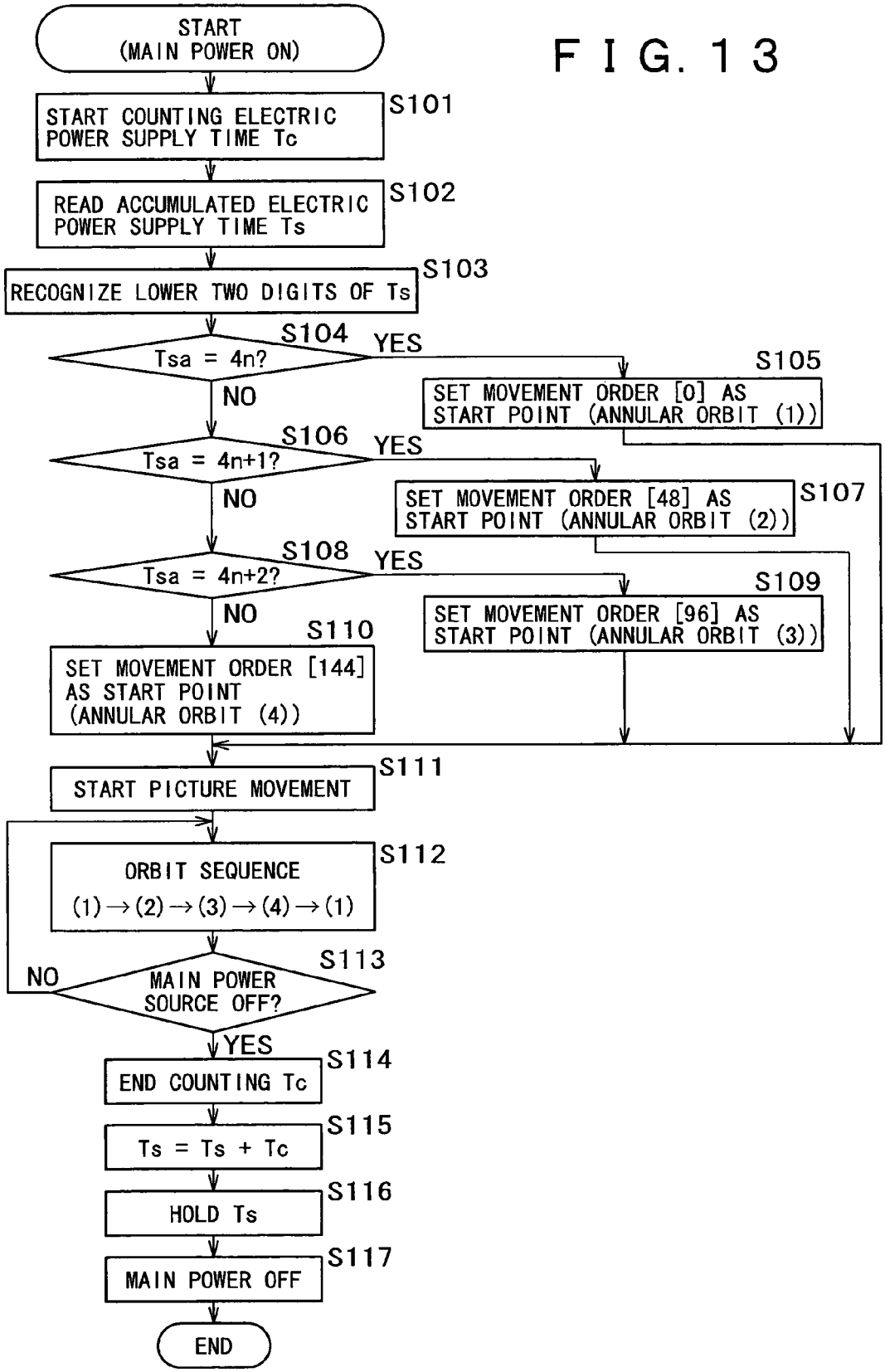
FIG. 13 is a flowchart showing a process for setting an annular orbit, when an image movement is started by a pixel shift, as the embodiment.

The process shown in FIG. 13 is started when the main power source is turned on and, for example, the display position control section 13 and the signal processing/synchronizing control section 12 are actuated. At first, at a process of a step S101, it starts counting the energized time Tc from this time when the power source is turned on. Together with this process, as a process at a step S102, it reads out the accumulated energized time Ts that is currently stored.

At a step S103, it recognizes a value Tsa of lower two digits of the accumulated energized time Ts read out at the step S102. The value Tsa at this time is treated so as to have the value as a natural number between 00 and 99, in a decimal number representation.

Then, whether or not Tsa=4n (n is any natural number) is established for this recognized value Tsa is judged at a next step S104. Here, if Tsa=4n is judged to be established, the process proceeds to a step S105. Then, the annular orbit (1) is selected as the annular orbit from which the image movement is started, from the four annular orbits constituting the quadruple annular orbit. In other words, the setting is executed for starting the image movement from a movement order number [0] in a table shown in FIG. 6.

Also, at the step S103, if Tsa=4n is judged to be not established, the process proceeds to a step S106. Then, it is judged whether or not Tsa=4n+1 is established. Here, if the judgment result of the establishment of Tsa=4n+1 is obtained, the process proceeds to a step S107. Then, the annular orbit (2) is selected as the annular orbit from which the image movement is started. In other words, the setting is executed for starting the image movement from a movement order number [48] in the table shown in FIG. 6.

On the contrary, at the step S106, if Tsa=4n+1 is judged to be not established, the process further proceeds to a step S108. Here, it is judged whether or not Tsa=4n+2 is established.

If the judgment result of the establishment of Tsa=4n+1 is obtained at the step S108, the process proceeds to a step S109. At the step S109, the annular orbit (3) is selected as the annular orbit from which the image movement is started. In other words, the setting is executed for starting the image movement from a movement order number [96] in the table shown in FIG. 6.

If the judgment result that Tsa=4n+2 is not established is obtained at the step S108, the value Tsa has the value represented by Tsa=4n+3. However, in this case, the process at a step S110 selects the annular orbit (4) as the annular orbit from which the image movement is started. In other words, the setting is executed for starting the image movement from a movement order number [144] in the table shown in FIG. 6.

In this way, this embodiment is designed such that the value Tsa of the lower two digits is especially treated as the random number, at the time of the accumulated energized time Ts, and the annular orbit from which the image movement is started is selected on the basis of this value Tsa, by the processes at the steps S104 to 110.

Then, at a step S111, the image movement is started from the annular orbit selected by the processes at the steps S104 to S110. Hereafter, the image movement through the quadruple annular orbit is continued such that the cycling is carried out in the order of the annular orbits (1)→(2)→(3)→(4)→(1) . . . , as shown as the process at a step S112. The control for this image movement is executed until the main power source is judged to be turned off at a step S113.

Then, if the main power source is judged to be turned off at the step S113, at a step S114, the counting operation of the energized time Tc executed until this time is ended and stopped after the power source is turned on at this time. At a next step S115, this accumulated energized time Ts is updated by adding the value of this energized time Tc to the accumulated energized time Ts held until this time. Then, at a step S116, this updated accumulated energized time Ts is rewritten on a memory and stored therein. If the process until this time has been ended, the main power source is turned off, for example, by a process at a step S117.

By the way, the present invention should not be limited to the configurations of the preferred embodiments described herein. For example, the benefits of the present invention are exhibited even if the image movement is done through one, two, three, five or more annular orbits by means of only one annular orbit in the quadruple annular orbit shown in FIG. 4. In other words, the annular orbit according to the present invention is designed such that the reference point Pt, at which the image is originally displayed, is used as the start point, and the image is moved so as to return back to this reference point Pt. Thus, as compared with the case in which it is moved through one annular orbit around the reference point Pt, the movement of the image is not visually outstanding. In addition, due to the implementation of the quadruple annular orbit that has been explained as the embodiment until this time, the movement of the image is further hard to be visually recognized, and the ghost effect reduction is improved.

In addition, considering a plurality of annular orbits, it is possible to yield similar effects or benefits as those that may be obtained through the example of preferred embodiment present herein, by using double, triple, quintuple or a higher number of annular orbits instead of the quadruple annular orbits presented in this specification. In other words, there is no specific limitation as to the number of annular orbits to adopt.

Also, although in the present description of preferred embodiments of the invention, description has been made with the concept that the image is moved along a plurality of annular orbits, it is also possible to consider a different concept as follows.

In other words, taking that there is an orbit of predetermined shape as an annular orbit, image movement is performed based on this annular orbit by sequentially changing the predetermined orbit, with the reference point Pt as an origin.

According to such concept, the quadruple annular orbit of the preferred embodiment of the present invention is obtained by first setting a circular-shaped orbit and then sequentially moving the image through moving locus represented by the annular orbits (1)→(2)→(3)→(4) as shown above which are based on the circular-shaped orbit.

Also, in FIG. 5 in which the quadruple annular orbit, for example, shown in FIG. 4 is simulated, the movement locus between the display pixels as the respective annular orbits exhibits the pattern of the rhomb similar to the substantially regular square. This is intended to limit the display pixel range to which the annular orbit is applied and attain simplification of explanation. As a result, the actual movement locus between the display pixels through the respective annular orbits exhibits the shape closer to a circle. Alternatively, the movement locus of display pixels within each annular orbit has not to assume a circular shape. For example, it may be an elliptic orbit that is extended longitudinally or laterally.

Also, the present invention can be applied to displaying apparatuses other than plasma displays.

Accordingly, it should be understood that the description above show mere examples of preferred embodiments of the present invention. Therefore, the present invention should not limited to such preferred embodiments, so that many other modifications, variations, combinations and sub-combinations of such embodiments and equivalents thereof may be made without departing from the scope and spirit of the present invention.

What is claimed is:

1. An image display control apparatus for executing a display control to display an image based on an input image signal on a displaying apparatus having a display screen, the image display control apparatus comprising:

a display controller to move and display said image through an image movement orbit having a central point of said image as a reference position used as a starting and returning point, and to repeatedly execute said image movement, said display controller having a memory to store accumulated energized time corresponding to a sum total time in which a main power source of the displaying apparatus is turned on, said display controller to count current energized time representative of an amount of time in which power is turned on in a current session and to add the current energized time to the accumulated energized time stored in the memory in a previous session to obtain updated accumulated energized time which is stored in the memory upon detecting that the main power source of the displaying apparatus has been turned off, said image movement orbit having a plurality of annular orbits sharing said reference position in which each of the annular orbits is located at a different position when displayed on the display screen, and in which said plurality of annular orbits includes at least a first annular orbit and a second annular orbit arranged such that the first annular orbit is located upwardly or downwardly from the second annular orbit and such that a center thereof is on a line which extends from a center of the second annular orbit at a direction which is at a 45 degree angle relative to a horizontal line which passes through the center of the second annular orbit, and said display controller selects an annular orbit from which image movement begins from said plurality of annular orbits, based on a value associated with a lower two digits of the accumulated energized time stored in the memory when the power is turned on to start the current session.

2. The image display control apparatus according to claim 1, wherein:

said plurality of annular orbits are sequentially selected so as to obtain a selected sequence, and said display control is executed by said display controller so that said image is moved from a beginning annular orbit in accordance with the selected sequence.

3. The image display control apparatus according to claim 2, wherein said plurality of annular orbits includes two pairs of annular orbits having said reference position as a respective contact position over a tangential line, wherein a positional relation between said two pair of annular orbits is set such that the tangential line of one pair of annular orbits and the tangential line of the other pair of annular orbits are orthogonal to each other.

4. The image display control apparatus according to claim 1, wherein:

said display screen is in a shape of a horizontal direction and vertical direction matrix formed of pixels constituted by a set of display cells of three colors;

said display controller causes movement by units of said pixel arrayed in the matrix, as a display control to move and display said image through said image movement orbit; and movement from a current pixel to a next pixel comprises a movement to a pixel adjacent to the current pixel in a horizontal or vertical direction.

5. An image display control method of executing a display control to display an image based on an input image signal on a displaying apparatus having a display screen, the image display control method comprising storing accumulated energized time in a memory corresponding to a sum total time in which a main power source of the displaying apparatus is turned on, counting current energized time representative of an amount of time in which power is turned on in a current session and adding the current energized time to the accumulated energized time stored in the memory in a previous session to obtain updated accumulated energized time which is stored in the memory upon detecting that the main power source of the displaying apparatus has been turned off, and moving and displaying said image through an image movement orbit having a central point of said image as a reference position used as a starting and returning point, and to repeatedly execute said image movement orbit, said image movement orbit having a plurality of annular orbits sharing said reference position in which each of the annular orbits is located at a different position when displayed on the display screen, and in which said plurality of annular orbits includes at least a first annular orbit and a second annular orbit arranged such that the first annular orbit is located upwardly or downwardly from the second annular orbit and such that a center thereof is on a line which extends from a center of the second annular orbit at a direction which is at a 45 degree angle relative to a horizontal line which passes through the center of the second annular orbit, and selecting an annular orbit from which image movement begins from said plurality of annular orbits, based on a value associated with a lower two digits of the accumulated energized time stored in the memory when the power is turned on to start the current session.

6. The image display control method according to claim 5, wherein said plurality of annular orbits are sequentially selected so as to obtain a selected sequence, and said display control is executed so that said image is moved from a beginning annular orbit in accordance with the selected sequence.

* * * * *